US010441117B2

(12) United States Patent
Osborne, Jr.

(10) Patent No.: US 10,441,117 B2
(45) Date of Patent: Oct. 15, 2019

(54) ELECTRONIC DISPENSER FOR FLEXIBLE ROLLED SHEET MATERIAL

(71) Applicant: Charles Agnew Osborne, Jr., Cumming, GA (US)

(72) Inventor: Charles Agnew Osborne, Jr., Cumming, GA (US)

(73) Assignee: Valve Solutions, Inc., Alpharetta, GA (US)

( * ) Notice: Subject to any disclaimer, the term of this patent is extended or adjusted under 35 U.S.C. 154(b) by 216 days.

(21) Appl. No.: 15/173,970

(22) Filed: Jun. 6, 2016

(65) Prior Publication Data

US 2016/0353946 A1 Dec. 8, 2016

Related U.S. Application Data

(60) Provisional application No. 62/230,404, filed on Jun. 4, 2015.

(51) Int. Cl.
*A47K 10/36* (2006.01)
*B26F 3/02* (2006.01)
(Continued)

(52) U.S. Cl.
CPC ..... *A47K 10/3643* (2013.01); *B65H 16/005* (2013.01); *B65H 20/02* (2013.01); *A47K 2010/3668* (2013.01); *B26F 3/02* (2013.01); *B65H 2301/4493* (2013.01); *B65H 2301/5154* (2013.01); *B65H 2404/13161* (2013.01);
(Continued)

(58) Field of Classification Search
CPC ..... A47K 10/3612; A47K 10/3618; A47K 10/3606; A47K 10/3625; A47K 2010/3668; B26F 3/02; B65H 15/005; B65H 20/02; B65H 2407/147; B65H 2511/511;
(Continued)

(56) References Cited

U.S. PATENT DOCUMENTS 3,554,456 A 1/1971 Moore
4,690,344 A * 9/1987 Yokota ..... A47K 10/34 225/10
(Continued)

OTHER PUBLICATIONS

U.S. Appl. No. 10/967,976, filed Oct. 19, 2004.
(Continued)

*Primary Examiner* — Clark F Dexter
(74) *Attorney, Agent, or Firm* — Womble Bond Dickinson (US) LLP

(57) ABSTRACT

An electronic dispenser for dispensing flexible sheet material. A control circuit receives a plurality of signals and controls dispensing of the sheet material. A tear bar is mounted within the housing for severance of the sheet material. A pivotally mounted pawl member is located proximate to the tear bar such that movement of the sheet material into the tear bar for severance pivots the pawl member from a first position to a second position, such movement causing a signal to be sent to the control circuit. The dispensing mechanism is operative in a first mode to be responsive to a signal from a proximity sensor to dispense a sheet of material, and is operative in a second mode to dispense a next sheet in response to the signal activated by movement of the pawl member to the second position in response to dispensed sheet material being removed from the dispenser.

10 Claims, 20 Drawing Sheets

(51) Int. Cl.
*B65H 16/00* (2006.01)
*B65H 20/02* (2006.01)

(52) U.S. Cl.
CPC .... *B65H 2404/147* (2013.01); *B65H 2511/22* (2013.01); *B65H 2511/511* (2013.01); *B65H 2553/22* (2013.01); *B65H 2553/414* (2013.01); *B65H 2553/51* (2013.01); *B65H 2701/1924* (2013.01); *Y10S 83/949* (2013.01); *Y10T 83/896* (2015.04)

(58) Field of Classification Search
CPC ..... B65H 2553/22; B65H 2553/414; Y10T 83/889; Y10T 83/896; Y10T 83/902
USPC ..... 83/648–650, 949; 242/564, 564.3, 564.4
See application file for complete search history.

(56) References Cited

U.S. PATENT DOCUMENTS 5,060,877 A 10/1991 Bullivant
5,441,210 A 8/1995 Hinton
5,848,609 A 12/1998 Marchesseault et al.
6,179,243 B1 1/2001 Granger
6,283,139 B1 9/2001 Symonds et al.
6,411,920 B1 6/2002 McConnell et al.
6,532,979 B1 3/2003 Richter
6,715,730 B2 4/2004 Ehr
6,892,746 B2 5/2005 Ford
6,895,848 B1 * 5/2005 Svensson ..... A47K 10/38 225/11
7,147,204 B2 12/2006 Hollingsworth
7,213,782 B2 5/2007 Osborne, Jr. et al.
7,370,824 B1 5/2008 Osborne
7,460,013 B1 12/2008 Osborne et al.
9,907,441 B2 * 3/2018 Osborne, Jr. et al. ..... A47K 10/38
2003/0019899 A1 1/2003 Chen et al.
2007/0194166 A1 * 8/2007 Reinsel et al. ..... A47K 10/36 242/563
2008/0128448 A1 6/2008 Cittadino et al.
2009/0057478 A1 3/2009 Conner
2010/0286817 A1 11/2010 Goeking et al.
2012/0312853 A1 12/2012 Osborne et al.
2014/0263812 A1 9/2014 Osborne
2015/0297043 A1 10/2015 Obsorne et al.
2016/0353945 A1 * 12/2016 Osborne, Jr. ..... A47K 10/3618

OTHER PUBLICATIONS

U.S. Appl. No. 11/120,732, filed May 3, 2005.
U.S. Appl. No. 13,155,528, filed Jun. 8, 2011.
U.S. Appl. No. 13/842,343, filed Mar. 15, 2013.
U.S. Appl. No. 14,256,019, filed Apr. 18, 2014.

* cited by examiner

ELECTRONIC DISPENSER FOR FLEXIBLE ROLLED SHEET MATERIAL

CROSS REFERENCE TO RELATED APPLICATIONS

The present patent application is a formalization of previously filed, U.S. Provisional Patent Application Ser. No. 62/230,404, filed Jun. 4, 2015 by the inventors named in the present Application. This patent application claims the benefit of the filing date of this cited Provisional patent application according to the statutes and rules governing provisional patent applications, in particular 35 U.S.C. § 119(e), and 37 C.F.R. §§ 1.78(a)(3) and 1.78(a)(4). The specification and drawings of the Provisional patent application referenced above are specifically incorporated herein by reference as if set forth in their entirety.

TECHNICAL FIELD

Embodiments of the disclosure relate generally to paper product dispensers and, more particularly, to electronic dispensers for flexible sheet material.

BACKGROUND

The dispensing of paper products has resulted in many different types of dispensing devices for controlling quantities dispensed as well as for determining how efficiently the paper products are dispensed. Primarily, these dispensers use mechanical paper feeding mechanisms, actuated by the user physically touching the dispenser equipment to deliver a fixed length of paper. This bodily contact can raise concerns over hygiene when such dispensers are located in public restroom facilities.

The use of electronic dispensers is becoming more prevalent especially in public restroom facilities where the electronic dispensers dispense a measured length of sheet material upon sensing the presence of a user. In such "hands free" operation, the user does not manually activate or otherwise contact the dispenser in order to initiate a dispense cycle.

Conventional electronic dispensers accumulate and discharge static electricity during the dispense cycle. Static charge can be generated by various components or operations such as the movement of sheet material over rollers, interactions between rollers, etc. If the static charge is not dissipated, the user may receive a static shock if he touches the dispenser during use. In addition, the static charge can adversely affect the electronic control and sensor circuitry in the dispenser.

SUMMARY

In one aspect of this disclosure, an electronic dispenser is provided for dispensing flexible sheet material. The electronic dispenser can operate in a number of modes including a proximity detection mode in which a proximity sensor detects the presence of a user's hand when placed into proximity with the dispenser, and a butler mode in which the dispenser automatically dispenses another measured sheet of sheet material. In butler mode, the electronic dispenser does not use a hand detection proximity sensor. Embodiments of the invention disclosed herein are operative in multiple modes. A dispenser housing contains a support mechanism for holding at least one roll of sheet material, and includes a base for mounting to a surface, a cover pivotally mounted to the base, and a discharge chute formed within the housing for discharging the sheet material from the dispenser. A control circuit in the housing controls dispensing of the sheet material from the housing. A dispensing mechanism drives sheet material from the housing upon receiving a signal from the control circuit. The dispenser includes an adjustable proximity sensor. A tear bar is mounted within the housing for severance of sheet material by the user. A pivotally mounted pawl member is located proximate to the tear bar such that movement of sheet material into the tear bar for severance pivots the pawl member from a first position to a second position. A signal means cooperative with the pawl member is located such that movement of the pawl member to the second position causes the signal means to send a signal to notify the control circuit that the sheet material may have been removed. The dispensing mechanism is operative in a first mode to be responsive to a signal from the proximity sensor to dispense a sheet of material, and is operative in a second mode to dispense a next sheet in response to the signal means being activated by movement of the pawl member to the second position.

In another aspect, an electronic dispenser is provided for dispensing flexible sheet material. A dispenser housing contains a support mechanism for holding at least one roll of sheet material, and includes a base for mounting to a surface, a cover pivotally mounted to the base, and a discharge chute formed within the housing for discharging the sheet material from the dispenser. A control circuit in the housing controls dispensing of the sheet material from the housing. A dispensing mechanism drives sheet material from the housing upon receiving a signal from the control circuit. The dispenser includes an adjustable proximity sensor. A tear bar is mounted within the housing for severance of sheet material by the user. A pivotally mounted pawl member is located proximate to the tear bar such that movement of sheet material into the tear bar for severance pivots the pawl member from a first position to a second position. A signal means cooperative with the pawl member is located such that movement of the pawl member to the second position causes the signal means to send a signal to notify the control circuit that the sheet material may have been removed from the discharge chute. A paper detection sensor is activated by the control circuit to verify that the sheet material has been removed from the discharge chute. The dispensing mechanism is operative in a first mode to be responsive to a signal from the proximity sensor to dispense a sheet of material, and is operative in a second mode to dispense a next sheet in response to a signal from the paper detection sensor that the sheet material has been removed from the dispenser.

In a further aspect, an electronic dispenser is provided for dispensing flexible sheet material. A dispenser housing contains a support mechanism for holding at least one roll of sheet material, and includes a base for mounting to a surface, a cover pivotally mounted to the base, and a discharge chute formed within the housing for discharging the sheet material from the dispenser. A control circuit in the housing controls dispensing of the sheet material from the housing. A dispensing mechanism drives sheet material from the housing upon receiving a signal from the control circuit. The dispenser includes a proximity sensor having an adjustable detection range. A tear bar is mounted within the housing for severance of sheet material by the user, wherein movement of sheet material into the tear bar for severance moves the tear bar from a first position to a second position. The tear bar can be pivotally mounted or slideably mounted within the housing. A signal means cooperative with the tear bar is located such that movement of the tear bar to the second position causes the signal means to send a signal to notify the control circuit that the sheet material may have been removed from the discharge chute. A paper detection sensor is activated by the control circuit to verify that the sheet material has been removed from the discharge chute. The dispensing mechanism is operative in a first mode to be responsive to a signal from the proximity sensor to dispense a sheet of material, and is operative in a second mode to dispense a next sheet in response to a signal from the paper detection sensor that the sheet material has been removed from the dispenser.

In an additional aspect, the dispensing mechanism can include a drive mechanism or system including a drive belt arrangement that can drive one or more pressing rolls in conjunction with the operation of the feed roller. For example, a drive motor, which can include a DC motor, an AC motor, stepper motor, servo motor or other similar motor or actuator (powered by a battery pack or other power source) can drive a belt gear that in turn can be coupled to and drive the feed roller. The belt gear can engage and drive the feed roll by interaction with a gear or spindle mounted to a roller shaft of the feed roller, and can further drive one or more pressing rolls by driving a belt that engages a spindle or shaft of one or both pressing rolls. The belt gear can be driven by the drive motor directly or indirectly, such as by a gear transmission assembly wherein the drive motor drives a series of gears to in turn drive the belt gear; or by a further drive belt linking the belt gear to the drive motor for driving the belt gear by operation of the motor.

BRIEF DESCRIPTION OF THE DRAWINGS

These and other advantages and aspects of the embodiments of the disclosure will become apparent and more readily appreciated from the following detailed description of the embodiments taken in conjunction with the accompanying drawings, as follows.

FIG. 5 illustrates an alternative embodiment of an encoder mechanism for controlling the length of delivered sheet material.

FIG. 19B shows

DETAILED DESCRIPTION

The following description is provided as an enabling teaching of embodiments of the invention including the best, currently known embodiment. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances. Thus, the following description is provided as illustrative of the principles of the embodiments of the invention and not in limitation thereof, since the scope of the invention is defined by the claims.

The embodiments described utilize concepts disclosed in commonly-owned U.S. Pat. No. 7,213,782 entitled "Intelligent Dispensing System" and U.S. Pat. No. 7,370,824 entitled "Intelligent Electronic Paper Dispenser," both of which are incorporated by reference in their entireties herein. The embodiments also utilize concepts disclosed in published patent application US 2008/0100982 entitled "System and Method for Dissipating Static Electricity in an Electronic Sheet Material Dispenser" and incorporated by reference in its entirety herein.

Embodiments of the electronic dispenser include a drive motor and gear assembly mounted within the dispenser housing. The motor includes a drive shaft and a drive gear attached thereto that engages the shaft of the drive roller. The gear assembly transmits motive force from the motor to the drive roller. Thus, upon energizing the motor, the drive roller is caused to rotate, which results in conveyance of the sheet material disposed in the nip between the pressure roller and drive roller along the conveying path and out of the dispensing throat of the housing. A tear bar is disposed in the throat so that a user can separate a sheet of the material by grasping and pulling the sheet across the tear bar. In an alternative embodiment, an automatic cutting device may be provided to automatically cut the sheet of material.

It should be appreciated that the electronic dispenser is not limited to any particular style, configuration, or intended type of sheet material. For example, the dispenser may be a towel dispenser, toilet tissue dispenser, or any other sheet material dispenser.

Figure 8:
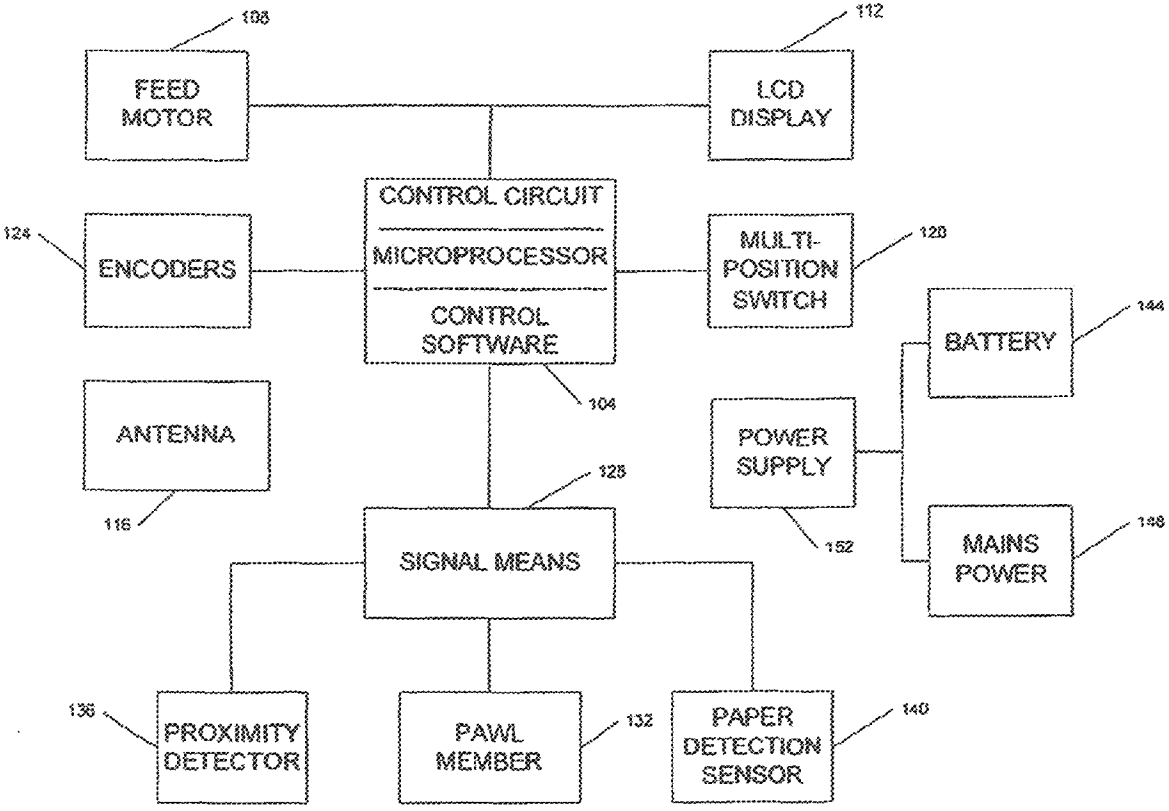
FIG. 8 illustrates a block diagram of the electronic control system contained within the dispenser in one embodiment.

FIG. 8 illustrates a block diagram of the electronic control system contained within the dispenser in an exemplary embodiment. The dispensing mechanism may be powered by batteries 144 contained in a battery compartment. Any suitable battery storage device may be used for this purpose. A conductor may be disposed below the battery compartment that mates with contacts on the underside of the battery compartment for delivering power 152 from the batteries 144 to the circuitry in the housing and the drive motor 108. Alternatively, or in addition to battery power, the dispenser may also be powered by a building's alternating current (AC) distribution system 148. For this purpose, a plug-in modular transformer/adapter could be provided with the dispenser, which connects to a terminal or power jack port located, for example, in the bottom edge of the circuit housing for delivering power to the control circuitry and associated components. The control circuitry 104 may include a mechanical or electrical switch that isolates the battery circuit upon connecting the AC adapter in order to protect and preserve the batteries.

In an electronic dispenser, a proximity sensor 136 may be provided to detect an object placed in a detection zone external to the dispenser. This sensor may be a passive sensor that detects changes in ambient conditions, such as ambient light, capacitance changes caused by an object in a detection zone, and so forth. In an alternate embodiment, the sensor may be an active device and include an active transmitter and associated receiver, such as one or more infrared (IR) transmitters and an IR receiver. The transmitter transmits an active signal in a transmission cone corresponding to the detection zone, and the receiver detects a threshold amount of the active signal reflected from an object placed into the detection zone. Control circuitry 104 is configured with the sensor 136 for initiating a dispense cycle upon a valid detection signal from the receiver.

The dispenser control circuitry 104 controls activation of the dispensing mechanism upon valid detection of a user's hand for dispensing a measured length of the sheet material. Sensors and associated circuitry may be provided for this purpose. Various types of sensors are well known to those skilled in the art, including IR, radio frequency (RF), capacitive sensors, etc. Any one or a combination of such sensing systems can be used.

The control circuitry 104 also controls the length of sheet material dispensed. Any number of optical or mechanical devices may be used in this regard. In exemplary embodiments of the electronic dispenser, an optical encoder 124 may be used to count the revolutions of the drive roller, with this count being used by the control circuitry to meter the desired length of the sheet material to be dispensed. In other embodiments, the control circuitry 104 may track the running time of the motor 108 as the control variable, or detect perforations in the sheet material.

In an exemplary embodiment, the processing logic for operation of the electronic dispenser in the hand sensor and butler modes is part of the control software stored in the memory of the microprocessor in the control circuit 104. One or more binary flags are also stored in memory and represent an operational state of the dispenser (e.g., "paper cut" set or cleared). An operational mode switch in the dispenser sets the mode of operation. In the hand sensor mode, the proximity (hand) sensor 136 detects the presence of a user's hand below the dispenser and dispenses a measured amount of sheet material. The control circuit 104 will then monitor when the sheet of material is removed. Both the pawl member 132 and the paper detection sensor 140 can determine the removal of paper and reset the hand sensor 136. The hand sensor 136 will not allow additional paper to be dispensed until the hand sensor 136 is reset. If the hand sensor 136 detects the presence of a user's hand but does not dispense sheet material, the control circuit 104 can check for sheet material using the paper detection sensor 140. If sheet material has not been dispensed (i.e., no sheet material is hanging from the dispenser), the feed motor 108 will be activated to dispense a next sheet.

In the butler mode, the proximity sensor 136 for detecting the presence of a user's hand is deactivated. The control circuit 104 will then automatically dispense sheet material when the cover is closed and the dispenser is put into operation. The paper detection sensor 140 will determine if a sheet is hanging from the dispenser. If sheet material is hanging, the control circuit 104 will then monitor when the sheet of material is removed. Both the pawl member 132 and the paper detection sensor 140 can determine the removal of paper and reset the dispenser. The next sheet will be dispensed automatically. If the paper detection sensor 140 determines the absence of hanging sheet material, the feed motor 108 will be activated to dispense the next sheet. The control circuit 104 will then determine if the sheet has been removed before dispensing another sheet.

Figure 9:
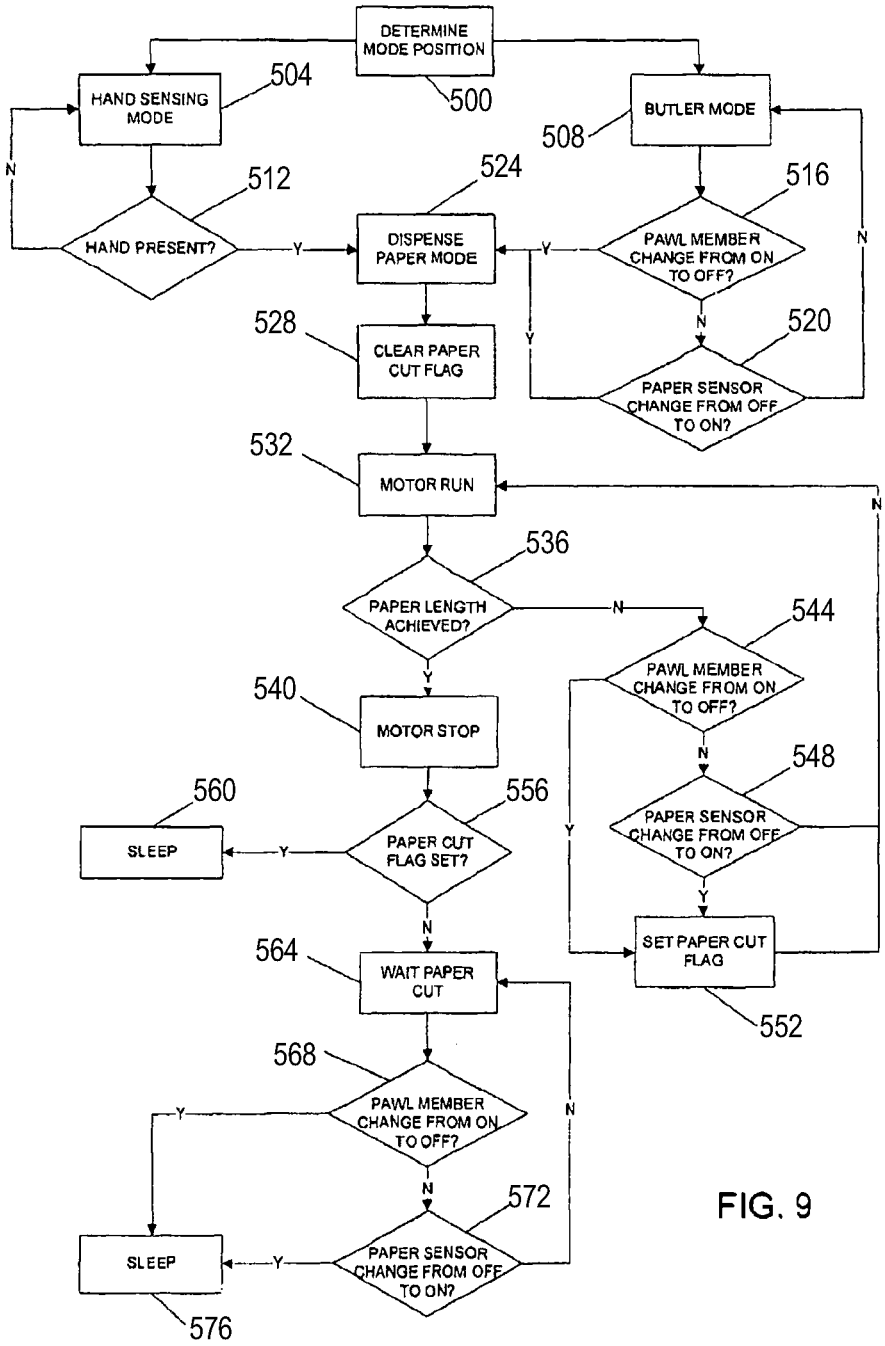
FIG. 9 illustrates the processing logic for operation of the electronic dispenser in a plurality of modes of operation in one embodiment.

FIG. 9 illustrates the processing logic of the control software for operation of the electronic dispenser in the hand sensor and butler modes in an exemplary embodiment. The processing logic first determines the position of an operational mode switch in logic block 500. If the electronic dispenser is in the hand sensing mode in logic block 504, the processing logic will determine if a hand is present in proximity to the hand sensor in decision block 512. Until the presence of a hand is detected, the dispenser will remain in hand sensing mode as indicated in logic block 504. If a hand is detected by the proximity sensor, the dispenser begins a dispense paper mode as indicated in logic block 524. A "paper cut" flag is then cleared in the control memory that stores the control software and flags for operation of the dispenser as indicated in logic block 528. The feed motor then runs as indicated in logic block 532 to dispense a predetermined length of sheet material.

If the predetermined paper length has been achieved in decision block 536, the feed motor stops running as indicated in logic block 540. In decision block 556, the state of the paper cut flag in control circuit memory is tested. In normal operation, the paper cut flag is set when the user tears the hanging paper from the dispenser. If the paper cut flag is set, the control circuit enters a sleep mode until the next user is detected. This step is indicated in logic block 560. If the paper cut flag is not set in decision block 556, the control software waits for a paper cut (i.e., user tears hanging paper) as indicated in logic block 564. In decision block 568, the processing logic checks whether or not the pawl member position has changed from on to off. In other words, this test determines if the pawl member has reset after the paper tear. If the pawl member has changed from the on to off position, the control circuit enters a sleep mode in logic block 576 until the next user is detected. If the pawl member has not changed from on to off, a test is performed by the control software to determine the status of the paper detection in decision block 572. If the paper detection sensor has changed from off to on, the control circuit enters a sleep mode as indicated in logic block 576. If the paper detection sensor is determined to be off, processing logic returns to logic block 564 to wait for a paper cut.

If the predetermined paper length has not been achieved in decision block 536, a test is made in decision block 544 to determine if the pawl member has changed from the on to off position. If the pawl member has changed to the on position, then the paper cut flag stored in control memory is set as indicated in logic block 552. This is followed in logic block 532 with the feed motor again running to dispense a predetermined length of sheet material. If it is determined in decision block 544 that the pawl member has not changed to the off position, a test is made in decision block 548 to determine if the paper detection sensor is on. If the paper detection sensor is on, the paper cut flag in control memory is set as indicated in block 552. The processing logic returns to logic block 532 to run the feed motor. If the paper detection sensor is determined to be off in decision block 548, the feed motor again runs (logic block 532) to dispense a predetermined length of sheet material.

If the electronic dispenser is in the butler mode of operation as indicated in logic block 508, the processing logic will determine if the pawl member has changed from the on to off position in decision block 516. If the pawl member has changed from the on to the off position, the dispenser will enter the dispense paper mode as indicated in logic block 524. If the pawl member has not changed from the on to the off position in decision block 516, a test is made in decision block 520 to determine the status of the paper detection sensor. If the paper detection sensor is found to be off, the dispenser remains in the butler mode as indicated in logic block 508. If the paper detection sensor is found to be on, the dispenser enters the dispense paper mode as indicated in logic block 524. Beginning with the dispense paper mode step of logic block 524, the processing logic (blocks 524-576) is the same for both hand sensing and butler modes.

Figure 1:
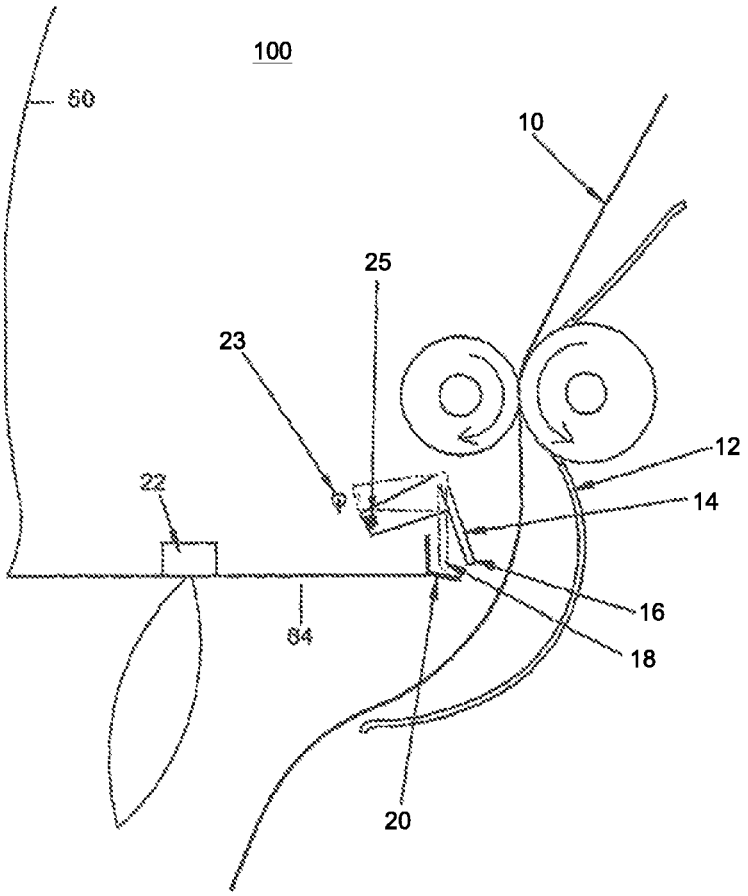
FIG. 1 illustrates a partial side view of a dispensing mechanism for dispensing flexible rolled sheet material having a moveable pawl member in one embodiment.
Figure 2B:
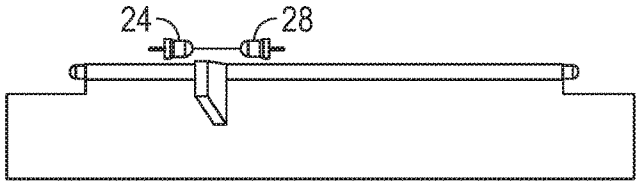
FIGS. 2A and B illustrate side and front views of a dispensing mechanism for dispensing flexible rolled sheet material having a moveable pawl member according to one embodiment.
Figure 2A:
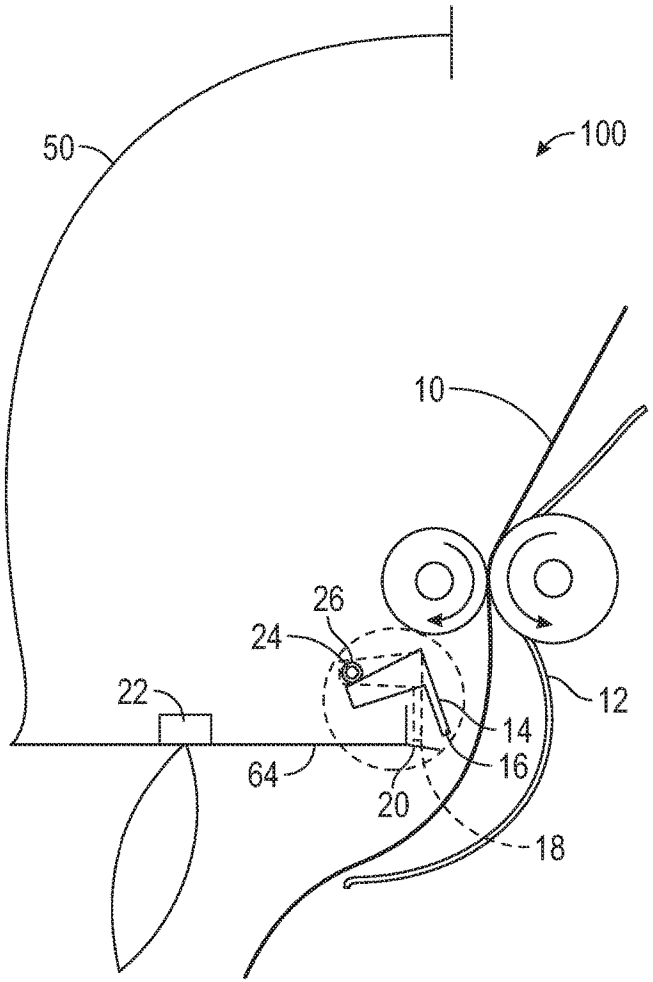

FIG. 1 illustrates a partial side view of a dispensing mechanism 100 for dispensing flexible rolled sheet material 10 having a moveable pawl member 14 in an exemplary embodiment. The electronic dispenser housing contains a support mechanism for holding at least one roll of sheet material. The roll of sheet material rides on a drive roller. With reference to FIGS. 1, 3A, 3B, and 8, in one embodiment, the housing can include a base panel 52 for mounting to an external surface, a cover panel 50 pivotally mounted to the base panel, and a discharge chute 12 formed within the housing for discharging the sheet material 10 from the dispenser 100. The support mechanism for the roll product could be pivotally mounted within the housing as discussed below. The control circuit 104 receives a plurality of signals from sensors 136, 140 and signal means 128 and controls dispensing of the sheet material 10 from the housing. The dispensing mechanism 100 is coupled to the motor 108 to drive sheet material 10 from the housing upon receiving a signal from the control circuit 104. The dispenser includes an adjustable proximity sensor 22 as the proximity sensor 136 to detect the presence of a user's hand and dispense measured amounts of sheet material 10. In the embodiment of the dispenser illustrated in FIGS. 1-2, a photoelectric, infrared (IR) sensing system may be used to detect the presence of a user's hands placed below the bottom portion of the dispenser housing. A tear bar 20 is rigidly mounted within the housing for severance of sheet material 10 by the user. The pivotally mounted pawl member 14 is located proximate to the stationary tear bar 20 such that movement of sheet material 10 into the tear bar 20 for severance pivots the pawl member 14 from a first position 16 to a second position 18.

In one embodiment, the signal means 128 cooperative with the pawl member 14 is located such that movement of the pawl member 14 to the second position 18 causes the signal means to send a signal to notify the control circuit 104 that the sheet material 10 has been removed. The signal means 128 that are cooperative with the pawl member 14 can include a magnet 25 and magnetic switch 23 or a mechanical switch. In another embodiment illustrated in FIG. 4, after receiving a signal that sheet material 10 may have been removed, the control circuit 104 can activate a paper detection sensor 44, 46 to verify that the sheet material 10 has been removed from the discharge chute 12.

In one embodiment, the dispensing mechanism 100 is operative in a first mode to be responsive to a signal from the proximity sensor 22 to dispense a sheet of material. The dispensing mechanism is operative in a second mode to dispense a next sheet in response to the signal means being activated by movement of the pawl member 14 to the second position 18 in response to dispensed sheet material 10 being removed from the dispenser. In another embodiment, the dispensing mechanism 100 is operative in a second mode to dispense a next sheet in response to the signal means being activated by movement of the pawl member 14 to the second position 18, and a signal from a paper detection sensor 44, 46 (FIG. 4) that the sheet material 10 has been removed from the dispenser. In the embodiment shown in FIG. 4, an emitter of the paper detection sensor can be affixed to an external surface of the discharge chute 12 rather than inside the discharge chute 12.

The pawl member 14 is electrically conductive and electrically connected to the control circuit forming a first part of an electric circuit. Movement of the pawl member 14 to the second position 18 brings the pawl member 14 into contact with one or more electrically conductive contact members. The conductive contact member is electrically connected to the control circuit 104 forming a second part of an electric circuit such that movement of the pawl member 14 into contact with the electrically conductive contact member completes the electric circuit and sends a signal to the control circuit 104.

In one embodiment, the signal means 128 cooperative with the pawl member 14 includes an infrared emitter and detector positioned opposite one another such that pivoting of the pawl member 14 to the second position 18 blocks reception of emitted light by the detector thereby sending a signal to the control circuit 104. In another embodiment, the signal means 128 cooperative with the pawl member 14 includes an infrared emitter/detector pair 24, 26 mounted in the housing such that moving the pawl member to the second position reflects emitted light back to the detector thereby sending a signal to the control circuit 104.

In a further embodiment not including a pawl member, an electronic dispenser 100 for dispensing flexible rolled sheet material 10 in an exemplary embodiment can have a moveable tear bar. Similar to the pawl member embodiments, the dispenser 100 housing contains a support mechanism for holding at least one roll of sheet material. The roll of sheet material 10 rides on a drive roller. The housing includes the base panel 52 for mounting to an external surface, the cover panel 50 pivotally mounted to the base panel, and the discharge chute 12 formed within the housing for discharging the sheet material 10 from the dispenser 100. The support mechanism for the roll of sheet material could be pivotally mounted within the housing. The control circuit 104 receives a plurality of signals and controls dispensing of the sheet material from the housing. The dispensing mechanism 100 is coupled to the motor 108 to drive sheet material 10 from the housing upon receiving a signal from the control circuit 104. The dispenser 100 includes the adjustable proximity sensor 22 for detecting the presence of a user's hand. A moveable tear bar (not shown) is mounted within the housing for severance of sheet material 10 by the user, wherein movement of sheet material 10 into the tear bar for severance moves the tear bar from a first position to a second position. The tear bar can be pivotally or slideably mounted within the dispenser housing.

In one embodiment, the signal means 128 cooperative with the tear bar is located such that moving the tear bar to the second position causes the signal means 128 to send a signal to notify the control circuit 104 that the sheet material may have been removed. The signal means 128 that are cooperative with the tear bar can include either a magnetic switch or a mechanical switch. In another embodiment, after receiving a signal that sheet material may have been removed, the control circuit 104 can activate the paper detection sensor 140 to verify that the sheet material has been removed from the discharge chute.

In one embodiment, the dispensing mechanism 100 is operative in a first mode to be responsive to a signal from the proximity sensor to dispense a sheet of material. In another embodiment, the dispensing mechanism 100 is operative in a second mode to dispense a next sheet in response to the signal means 128 being activated by the tear bar moving to the second position, and a signal from the paper detection sensor that the sheet material has been removed from the dispenser.

In one embodiment, the signal means 128 cooperative with the tear bar includes the infrared emitter and detector positioned opposite one another such that movement of the tear bar to the second position blocks reception of emitted light by the detector thereby sending a signal to the control circuit 104. In another embodiment, the signal means 128 cooperative with the tear bar includes the infrared emitter/detector pair 24, 26 mounted in the housing such that movement of the tear bar to the second position reflects emitted light back to the detector thereby sending a signal to the control circuit 104.

For some embodiments as shown in FIG. 8, a multi-position switch 120 in operable communication with the control circuit 104 is used to select one of a plurality of sheet lengths to be dispensed by the dispensing mechanism. The encoder 124 in operable communication with the control circuit 104 is used to control a measured length of delivered sheet material based on a setting of the multi-position switch 120.

In one embodiment, the multi-position switch 120 in operable communication with the control circuit 104 can be used to select a power output level delivered to the proximity sensor. The power output level is controlled by a resistive circuit comprising at least two resistors having different resistances. The multi-position switch 120 in operable communication with the control circuit 104 can be used to select one of a plurality of time periods as a delay between delivery of a first sheet and delivery of a next sheet to the user.

Figure 5:
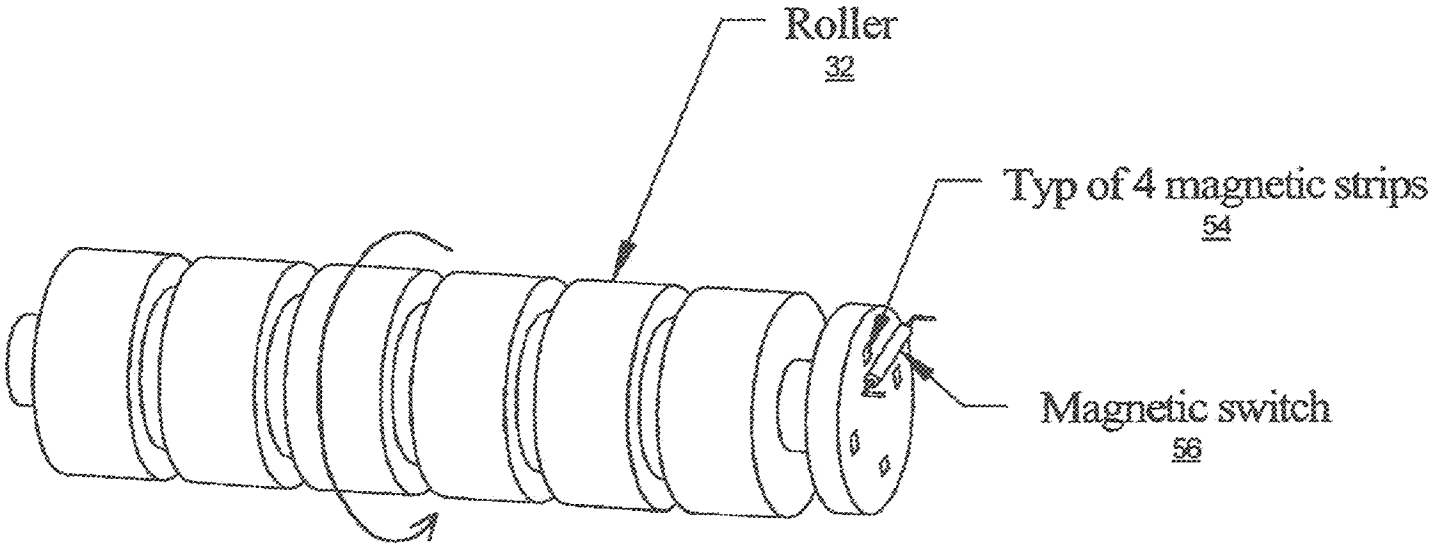
FIG. 5 illustrates an encoder mechanism for controlling the length of delivered sheet material in one embodiment.

With reference to FIG. 5, in one embodiment, an encoder could include a plurality of magnetic strips 54 integrally incorporated within or affixed around the periphery on one end of any roller 32 or any gear, and a magnetic switch 56 mounted in the housing in proximity to one end of any roller 32 or any gear such that magnetic strips 54 passing the magnetic switch 56 generate a series of pulses that the control circuit counts to determine when a selected amount of sheet material has been dispensed.

In another embodiment, an encoder could include a fan or star shaped reflective surface integrally incorporated within or affixed on one end of any roller or any gear and an infrared emitter/detector pair mounted in the housing in proximity to one end of any roller or any gear such that the leading and trailing edges of the reflective surface reflect emitted light back to the detector generating pulses countable by the control circuit to determine when a selected amount of sheet material has been dispensed.

Figure 6:
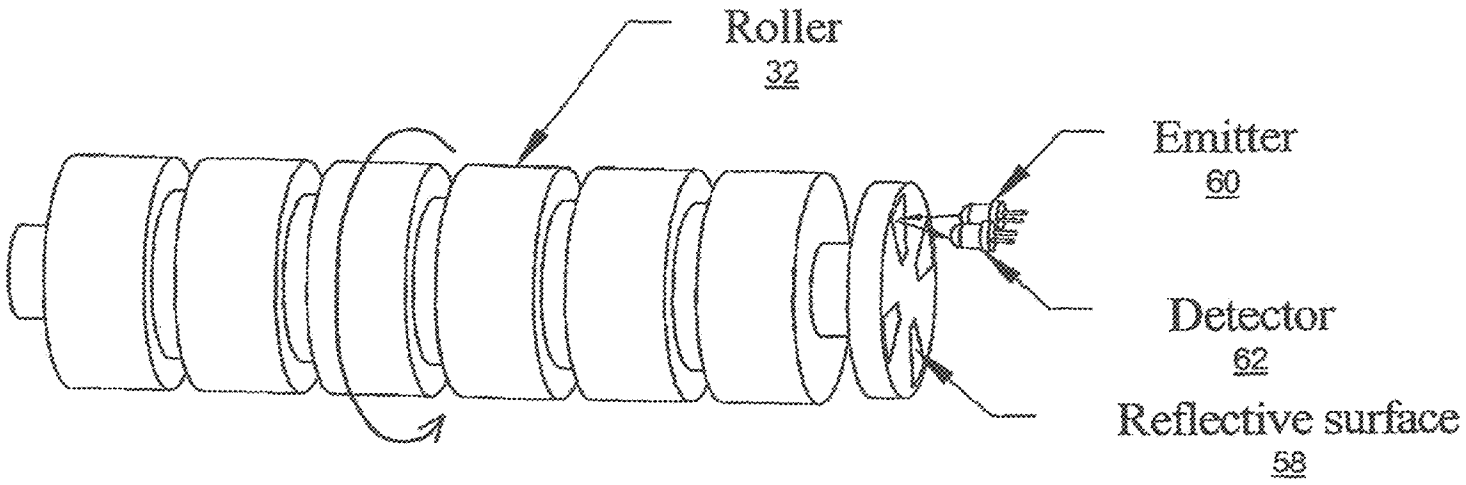

With reference to FIG. 6, in another embodiment, an encoder could include a plurality of reflective strips 58 integral to or affixed around the periphery on one end of drive roller 32 and an infrared pair 60, 62 mounted in the housing in proximity to said one end of the drive roller 32 such that the reflective strips 58 passing the infrared emitter/detector pair 60, 62 receive light from the emitter 60 and reflect light back to the detector 62 generating a series of pulses that the control circuit counts to determine when a selected amount of sheet material 10 has been dispensed.

Figure 4:
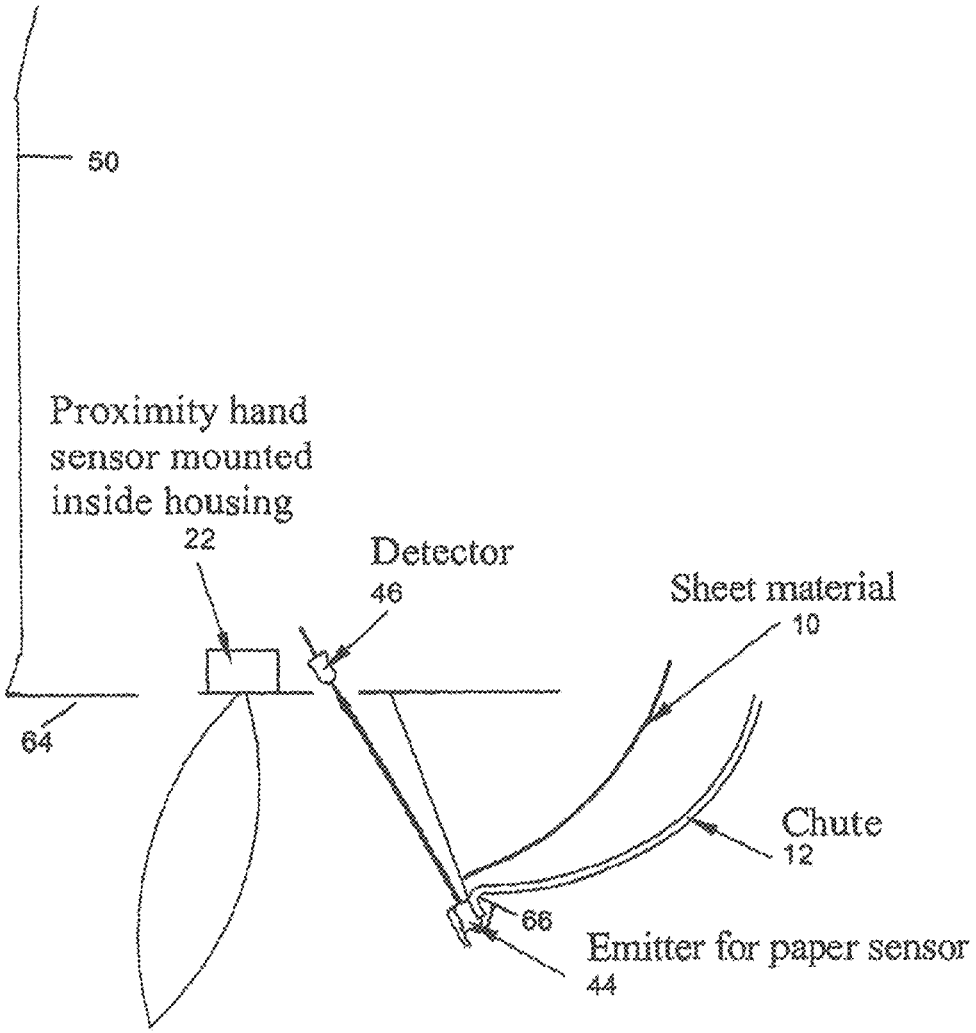
FIG. 4 illustrates a sensor mechanism for detecting the presence of sheet material in one embodiment.

As shown in FIG. 4, in one embodiment, the hand proximity sensor 22 could be mounted in a bottom panel 64 of the dispenser 100 housing forward of the discharge chute 12 facing downward and slightly rearward toward an outermost edge of the discharge chute 12. In this embodiment, the emitter 44 for the paper sensor could be mounted in a separate housing affixed adjacent to an outer surface 66 of the discharge chute 12 facing toward the bottom surface 64 of the dispenser housing where detector 46 will detect a signal from the emitter 44 in the absence of paper hanging from the discharge chute 12.

In some embodiments, the proximity sensor can detect both a user's hand and a sheet hanging below a front edge of the discharge chute. For example, the proximity sensor 22 could include one infrared emitter and one infrared detector with the infrared emitter aligned to detect both the presence of a user's hand below the dispenser 100 and a sheet 10 hanging below an outermost front edge of the discharge chute 12. In other embodiments, the proximity sensor could include two infrared emitters and one infrared detector with one infrared emitter aligned to detect a user's hand below the dispenser 100 and the second infrared emitter aligned to detect a sheet hanging below the outermost front edge of the discharge chute 12.

Figure 7:
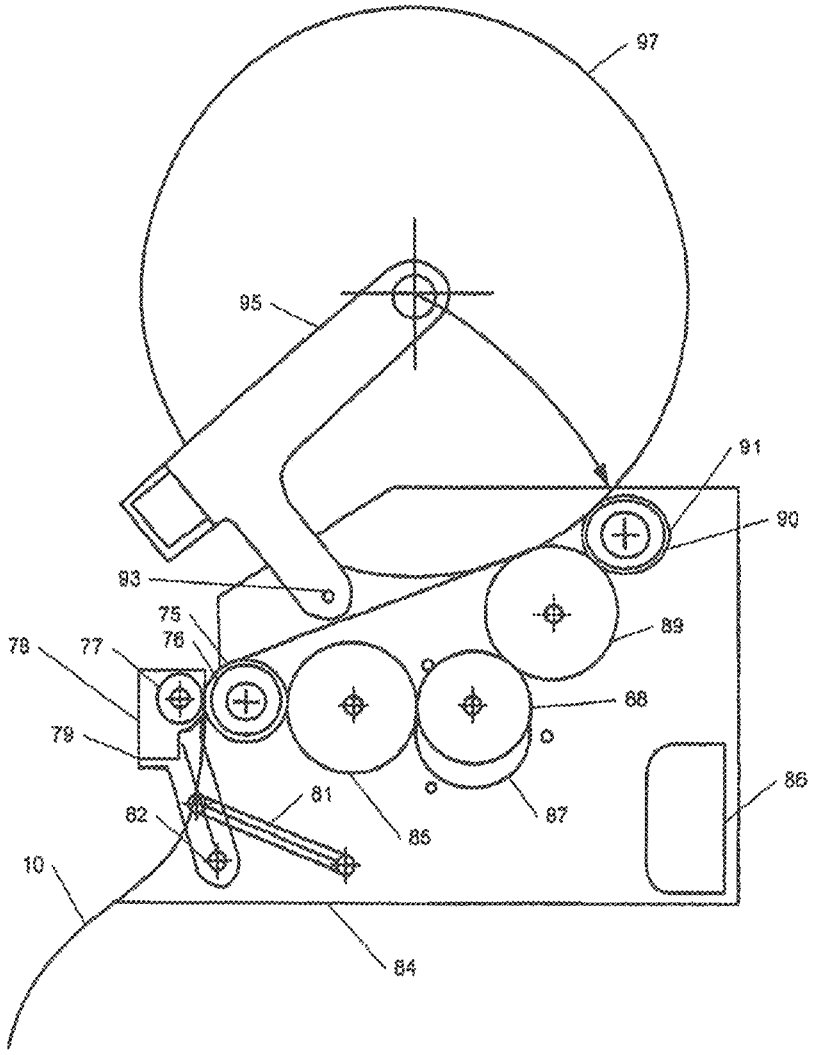
FIG. 7 illustrates a gravity-assisted roll feed mechanism in accordance with one exemplary embodiment.

FIG. 7 illustrates a gravity-assisted roll feed mechanism in accordance with an exemplary embodiment that can be used in the pawl member embodiments and the moveable tear bar embodiment. The description that follows is incorporated from U.S. Pat. No. 7,213,782 and retains the reference numbers used therein for convenience. An electric motor 87 and the associated gears 76, 85, 88, 89, 90 turn the main product roller 91 and the exit rollers 75, 77 simultaneously for sheet material evacuation. The main product roller 91 rolls the sheet material from roll 97 while the exit rollers 75, 77 guide the sheet material from roll 97 through the front cover of the dispenser opening for presentation to the user. The gravity assisted roll and feed mechanism dispenses sheet material from roll 97 by allowing the sheet material 10 to be rolled automatically and fed to the user more efficiently. The sheet material dispensed 10 is roll fed by gear 76 between the pressing roller 77 and the exit roller 75. Tear bar 79 cuts the dispensed sheet material 10. The sheet material length dispensed is adjustable and can be metered by the main product roller 91.

With further reference to FIG. 7, the gravity-assisted roll feed mechanism uses the electric motor 87 in dispenser 84 to turn a gear assembly which activates the main product roller 91 and exit guide rollers 75, 77. The main product roller 91 and exit guide rollers 75, 77 operate at the same speed to ensure sheet material uniformity during evacuation eliminating product overspin which leads to lower incidence of product misfeeding and or jamming. The sheet material holder 95 and axis 93 maintain a consistent friction coefficient between the main product roller 91 and the roll of sheet material 97 (as the diameter/weight of the sheet material roll 97 changes) by changing the angle of the roll of sheet material 97 as applied to the main roller 91. The sheet material holder 95 is equipped with bearings (not shown) for more efficient rolling and less paper dust. The gravity assisted roll and feed mechanism utilizes gravity as "free energy" to create the friction required to roll the sheet material on roll 97 on the main roller 91 limiting the friction required to feed the sheet material by the exit rollers 75, 77, hence providing a more efficient and consistent way to dispense sheet material. Consistent coefficient of friction in the present context does not mean a constant coefficient of friction between the roll of sheet material and main roller. It simply means that as the roll of sheet material is dispensed, the coefficient of friction does not make any radical or extreme changes. Additional embodiments of gravity-assisted roll feed mechanisms are described in U.S. Pat. Nos. 7,213,782 and 7,370,824 and are incorporated by reference herein.

With reference to FIG. 8, at least one battery 144 powers the motor 108, the proximity sensor 136, the signal means 128, and the control circuit 104. A rechargeable battery, such as a nickel metal hydride (NiMH) battery, can be used and sized for the power demand of the sheet material dispenser's electronics. A component within the control circuit 104 measures battery voltage periodically. In some embodiments, the control circuit 104 activates a low battery light visible on the outside of the housing when the battery reaches a predetermined low voltage level. In one embodiment, the amount of sheet material remaining on roll 97 as well as battery life and dispenser open/closed status can be displayed on a liquid crystal display (LCD) on the front panel of the dispenser.

Figure 3B:
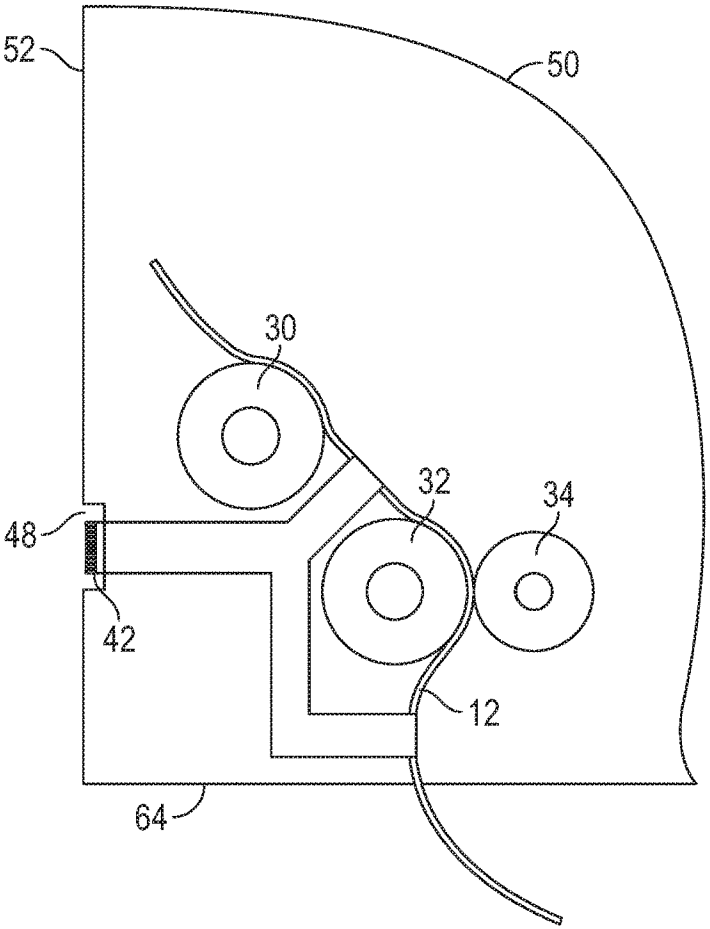
FIGS. 3A and B illustrate perspective and side views of an antenna arrangement for dissipating static electricity build-up in a dispensing mechanism for dispensing flexible rolled sheet material according to one embodiment.
Figure 3A:
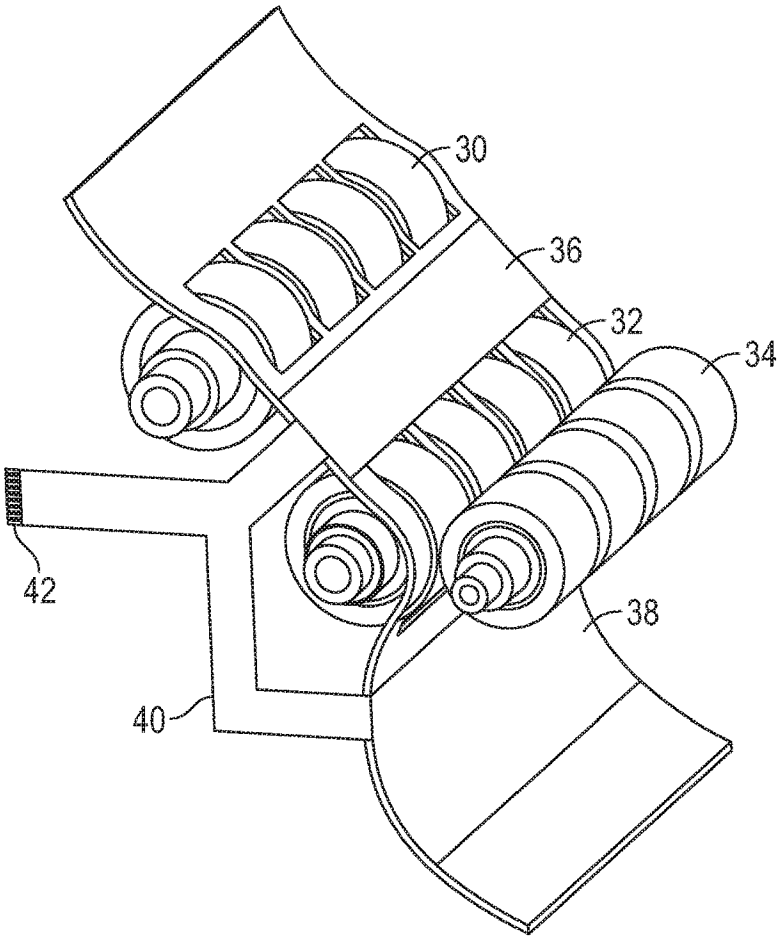

With reference to FIGS. 3A and 3B, the dispensing mechanism dispenses a measured length of the sheet material, which may be accomplished by various means, such as a timing circuit that stops the drive rollers 32, 34 after a predetermined time. In one embodiment, a revolution counter is provided that measures the degree of rotation of the drive rollers 32, 34 and is interfaced with control circuitry to stop a drive roller motor after a defined number of revolutions of the rollers 32, 34. This counter may be an optical encoder type of device, or a mechanical device. The control circuitry may include a device to allow maintenance personnel to adjust the sheet length by increasing or decreasing the revolution counter set point.

Static electricity build-up is a common problem in electronic sheet material dispensers that is generated from operation of the dispenser. Various methods for dissipating static charge build-up in electronic sheet material dispensers are within the scope of the invention, and include placing at least one component within the dispenser in electrical conductive communication with an antenna 42, 116 that is disposed relative to the dispenser housing to dissipate static charge to air surrounding the antenna. The antenna could be placed in electrical conductive communication with the component by any conventional low impedance means. For example, the component may be connected to the antenna through a wire, foil, or other conductive path. Any manner of conventional electrical connection may be used to interconnect the antenna 116, conductive members, and component.

The dispenser component may be any one or combination of elements that are susceptible to generating or accumulating static charge. For example, the component may be the shaft or surface of the drive roller or pressure roller. The component may be the tear bar against which the sheet material is pulled in order to separate a sheet of the material. In some embodiments, the component may be the sheet material itself. The antenna could be in conductive communication with the sheet material along any portion of the conveying path of the sheet material through the internal volume of the dispenser. A collection plate, such as a foil plate or strip, may be disposed along the conveying path of the sheet material at a location that ensures that the sheet material slides along the plate, such as where the sheet material changes direction. This collection plate is in conductive communication with the antenna to dissipate static charge from the sheet material.

In an alternate embodiment, the antenna could be in conductive communication with one or more internal components of the dispenser through an intermediate device. For example, the antenna and internal components may be wired to a common collection point or node. In another embodiment, the component may be wired to a ground terminal within the dispenser's control circuitry, with the antenna wired to the same terminal. Additional embodiments of static charge dissipating mechanisms for electronic dispensers are described in US 2008/0100982 and are incorporated by reference herein.

The antenna can include either a single point or a multipoint array. The antenna discharges static electricity to the air in the space surrounding the antenna. In some embodiments, the antenna can be connected to the tear bar. The antenna may be made from any material suitable for electrostatic conduction and ionization of air. For example, the antenna may constitute an exposed wire, strip of sheet metal, foil, etc. The dissipation system is not limited by the type or configuration of the antenna or materials. The antenna is desirably electrically isolated from other components of the dispenser and disposed so as to dissipate the static charge through a non-conductive material external to the dispenser housing. In one embodiment, the antenna can be located within the dispenser such that it is open to external air allowing the static charge to be dissipated through the air by corona discharge. This location may be defined by a component of the housing, for example, within an external wall of the dispenser housing. In one embodiment, the antenna can be disposed in the back wall of the dispenser housing. In this manner, the antenna is hidden from view and generally protected. A cover may be disposed over the recess to prevent access or inadvertent touching of the antenna by maintenance personnel. The cover could be perforated or otherwise contain passages for the free flow of air into the compartment.

Although not intended to be limited to any particular operational principle, it is believed that the antenna collects the relatively high static charge voltage of the dispenser components to ionize air molecules and induce a corona discharge in the air surrounding the individual antenna's sharp points. Since the ions are subjected to the electric field concentrated at the antenna points, ions of a polarity opposite to the static charge polarity will travel along the electric field lines to the antenna, thereby neutralizing the field. The oppositely charged ions are neutralized as they move beyond the ionization region. This process continues until the field has been reduced to the point where ionization of air ceases. This corona discharge principle is thus a function of the antenna's ability to induce ionization using the static charge received from the components in conductive communication with the antenna. The electrical energy generated during this process is small and insufficient to create a spark.

Aspects of the static charge dissipation system and method are described with reference to FIGS. 3A and 3B. The antenna 42 is located relative to the dispenser so as to be exposed to the exterior of the dispenser. In one embodiment, an antenna 42 could be located in a rear section 52 of the housing. The antenna 42 is connected to a conductive element 40 within the dispensing mechanism 100. The antenna 42 receives static charge generated by operation of the dispenser 100, the antenna 42 being electrically isolated and disposed so as to dissipate the static charge via a corona discharge to a non-conductive material external to the housing 100.

The antenna 42 is disposed in electrical conductive communication with at least one internal component of the dispenser 100 that is susceptible to generation and accumulation of static charge upon operation of the dispenser. In one embodiment, the antenna 42 is disposed within a recess 48 defined in the back wall 52 of the dispenser housing. The recess 48 in the back wall 52 of the housing hides and isolates the antenna 42 from users, and is only accessible upon removing the cover 50 from the supporting wall structure. It may be desirable to include a cover member (not shown) over the recess 48 to further isolate and protect the antenna 42. The cover member could be perforated or otherwise includes air passages therethrough so that the interior volume of the recess 48 is exposed to free airflow.

It should be appreciated that the antenna 42 need not necessarily be disposed within a recess 48, and may be disposed at any location relative to the dispenser 100 so as to be exposed externally. For example, the antenna 42 could be disposed at the top of the dispenser 100, or below the dispenser 100 along the underside 64.

The configuration and type of antenna 42 may vary. In the embodiment illustrated in FIGS. 3A and 3B the antenna 42 is defined by a multiple point array configuration, such as a branched configuration of multiple antenna arms. A multiple point antenna may be formed in various ways. For example, a strip of sheet metal may be bent into any desired antenna shape and have a plurality of individual "teeth" defined along the edge thereof, with each tooth constituting an antenna point. In another embodiment, a plurality of individual antenna points, such as copper barbs, may be welded or otherwise attached to a conductive metal base, such as a strip of sheet metal.

Any manner or combination of components within the dispenser 100 may be in electrical conductive communication with the antenna 42 for dissipating static charge. In the embodiment shown in FIGS. 3A and 3B, the drive roller 32, 34 are in conductive contact with metal plates 36, 38, respectively. The metal plates are connected to the antenna 42 within the recess 48 via metal structure 40. The shafts of either or both of the rollers may also be in communication with the antenna 42. The conductive paths established by the conductors 36, 38 may be defined at any convenient location within the interior volume of the dispenser 100.

In another embodiment, the tear bar 20 could be in conductive communication with the antenna 42. The tear bar 20 may be rigidly or movably mounted and, thus, the conductive path is appropriately configured to mate with the tear bar 20. For a rigid tear bar 20, the conductive path may be any suitable stationary electrical connection.

Figure 10B:
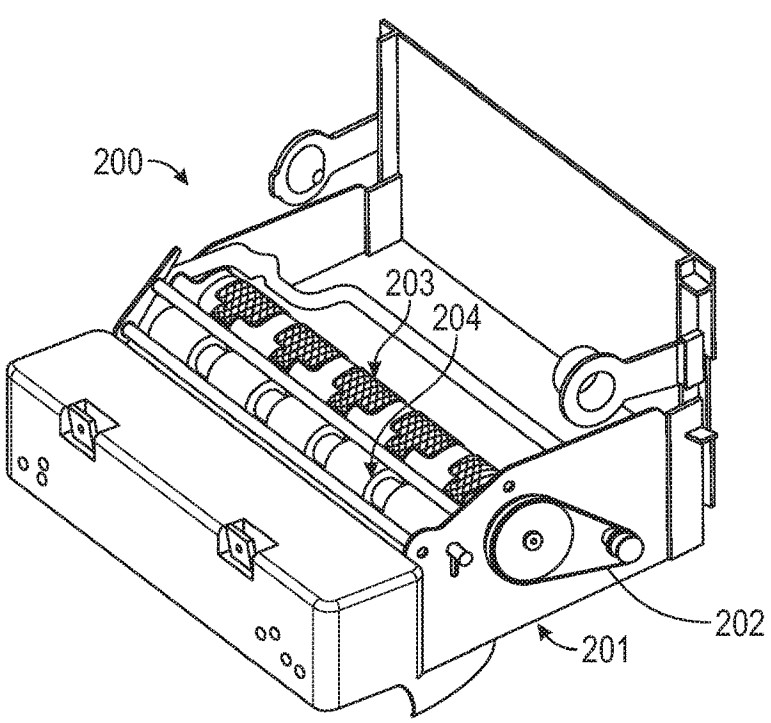
FIG. 10B shows a drive mechanism according to one embodiment for a dispensing mechanism as shown in FIGS. 1-2, with a drive belt in lieu of the transmission gears shown in FIG. 10A.
Figure 10A:
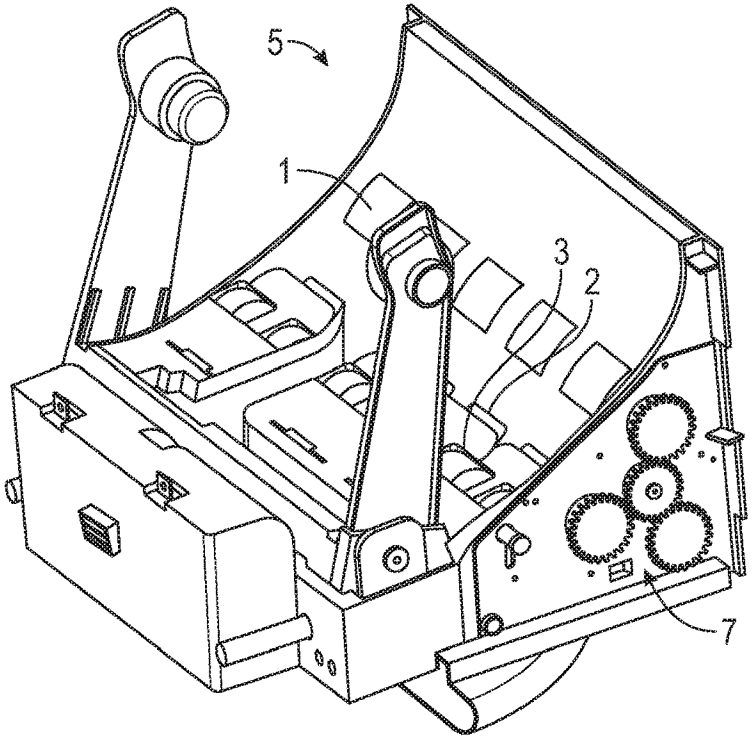
FIG. 10A shows a gravity-assisted roll feed mechanism, similar to the one shown in the embodiment of FIG. 7.

FIG. 10A shows a gravity-assisted roll feed mechanism 5 for feeding sheet materials such as paper, tissue, etc., similar to the roll feed mechanism shown in the embodiment of FIG. 7. FIG. 10A provides a transmission gear arrangement 7, a driving roller 1 that drives the paper, a paper roller 2 that delivers the paper, and a pressing roller 3.

FIG. 10B shows a dispensing/roll feed mechanism of FIG. 10A according to an additional embodiment. The dispensing/roll feed mechanism 200 shown in FIG. 10B, in one aspect, provides a belt drive mechanism 201 with an arrangement of drive belts including a drive belt 202 in place of the transmission gear arrangement 7 shown in FIG. 10A. The drive belt 202 shown in FIG. 10B reduces the transmission noise as compared to the transmission gear arrangement 7 of FIG. 10A. A paper roller 203 and pressing roller 204 are also shown in FIG. 10B.

Figure 11B:
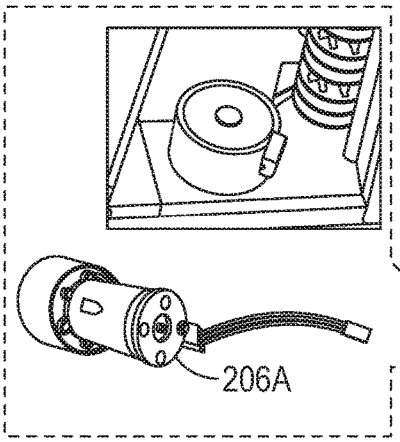
FIGS. 11A and B show a stepper motor in use with the drive mechanism according to FIG. 10B.
Figure 11A:
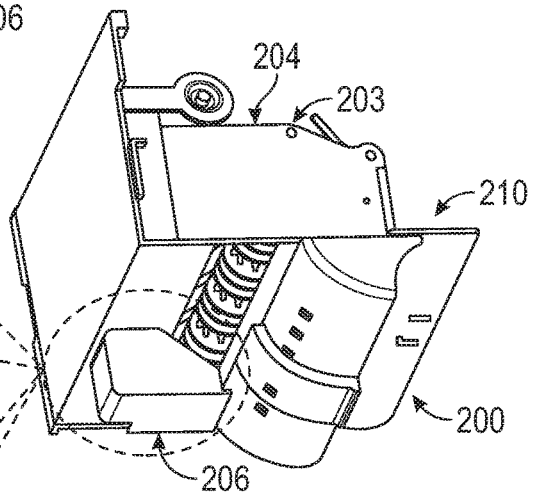
Figure 11C:
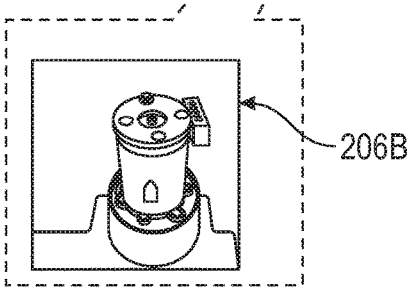

FIGS. 11A-11C show an alternative drive 206, here shown as a stepper motor 206A for use in the roll feed mechanism 200 of FIG. 10B. FIG. 11B shows an exploded view of the stepper motor 206A, while FIG. 11C shows an exploded view of a more conventional DC motor 206B. As shown in FIG. 11B, the stepper motor 206A can add a paper link counting function to the main circuit board, which allows the unit or mechanism to calculate the paper length accurately. Additionally, the noise for the stepper motor shown in FIGS. 11A and 11B generally can be much lower than the noise of many currently used DC motors, which also might need to add a circuit board at the end of the motor to get accurate data for paper length counting while the stepper motor as shown in FIGS. 11A and 11B directly adds the function to the board.

Figure 12A:
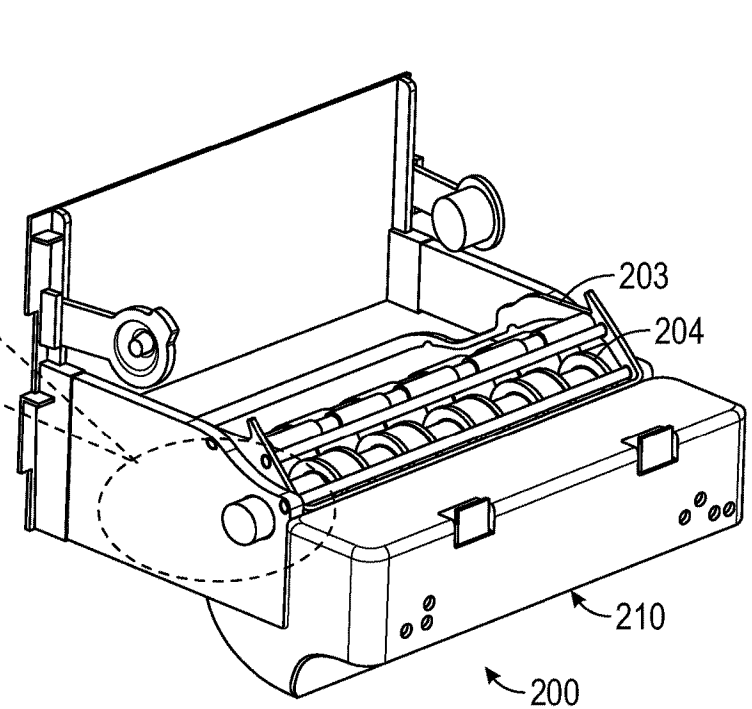
FIGS. 12A, B, C, and D show views of the drive mechanism according to one embodiment with an exploded view (FIG. 12B) at the upper left showing concealed bushings (FIGS. 12C and 12D).
Figure 12B:
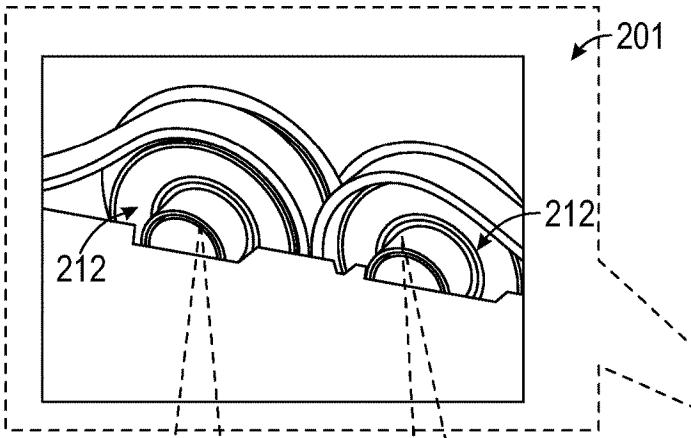
Figure 12D:
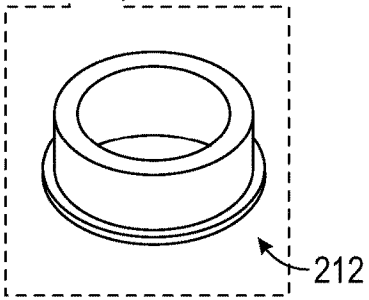
Figure 12C:
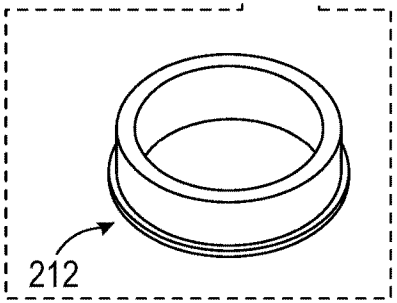

FIG. 12A shows a view of a base or lower portion 210 of the roll feed mechanism 200, and FIG. 12B show an exploded view shows concealed bushings 212. FIGS. 12C and 12C also show further exploded views of the concealed bushings 212. The bushings 212 can be formed from any suitable material to provide quiet rollers, such as POM. In the exemplary embodiment shown in FIGS. 12A-12D, there are a total of four pieces of bushings 212, though any number of bushing can be employed without departing from the present disclosure.

Figure 13:
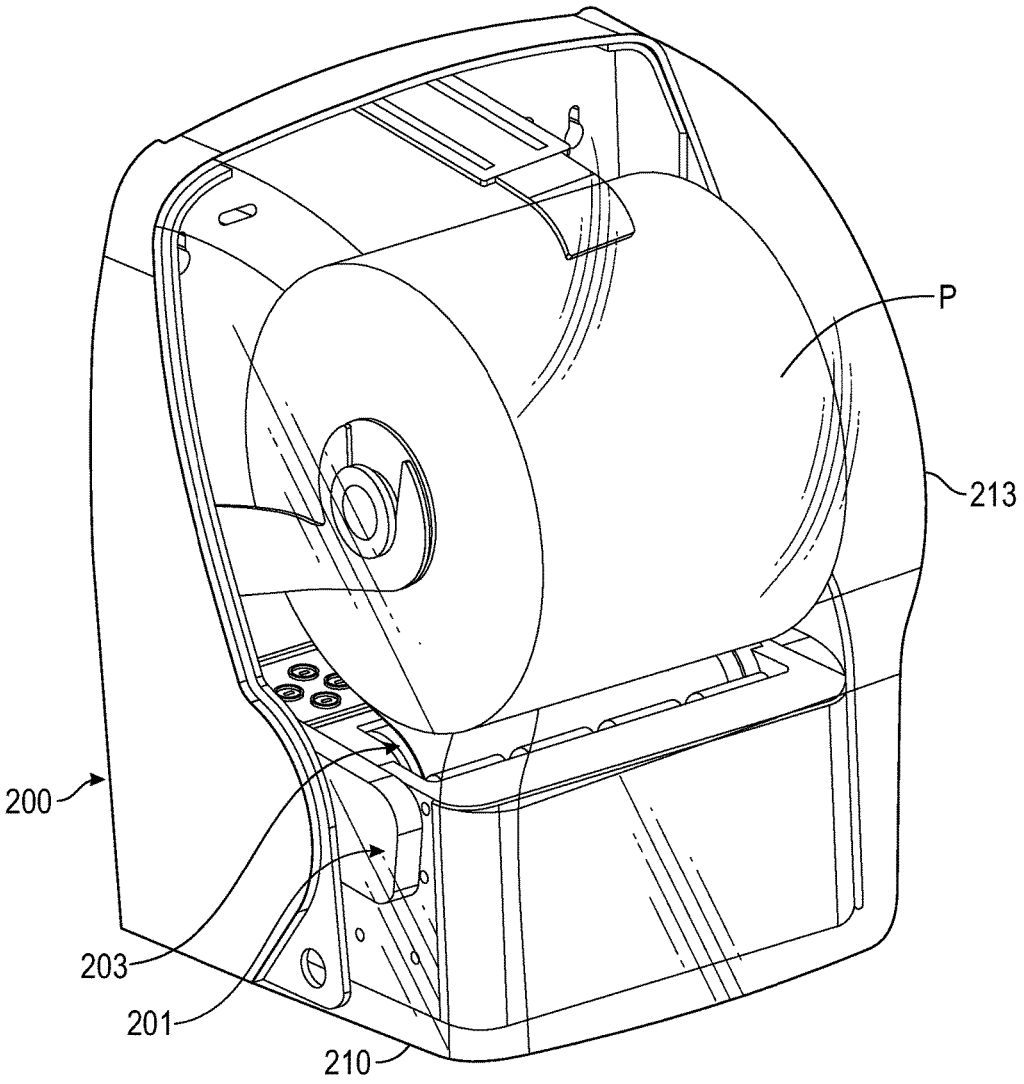
FIG. 13 shows a complete, assembled drive mechanism according to one embodiment.

FIG. 13 shows one embodiment of the complete, assembled roll feed mechanism 200 according to principles of the present disclosure. As shown in FIG. 13, the roll feed mechanism 200 includes a cover 213 and shows a roll of paper P installed in place beneath the cover 213.

Figure 14B:
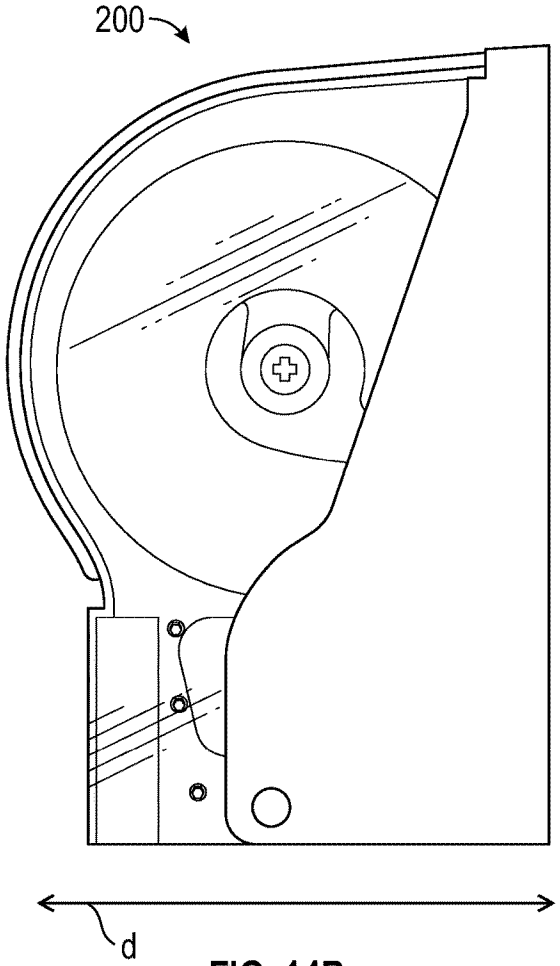
FIGS. 14A and 14B provide exemplary dimensions of the drive mechanism according to one embodiment.
Figure 14A:
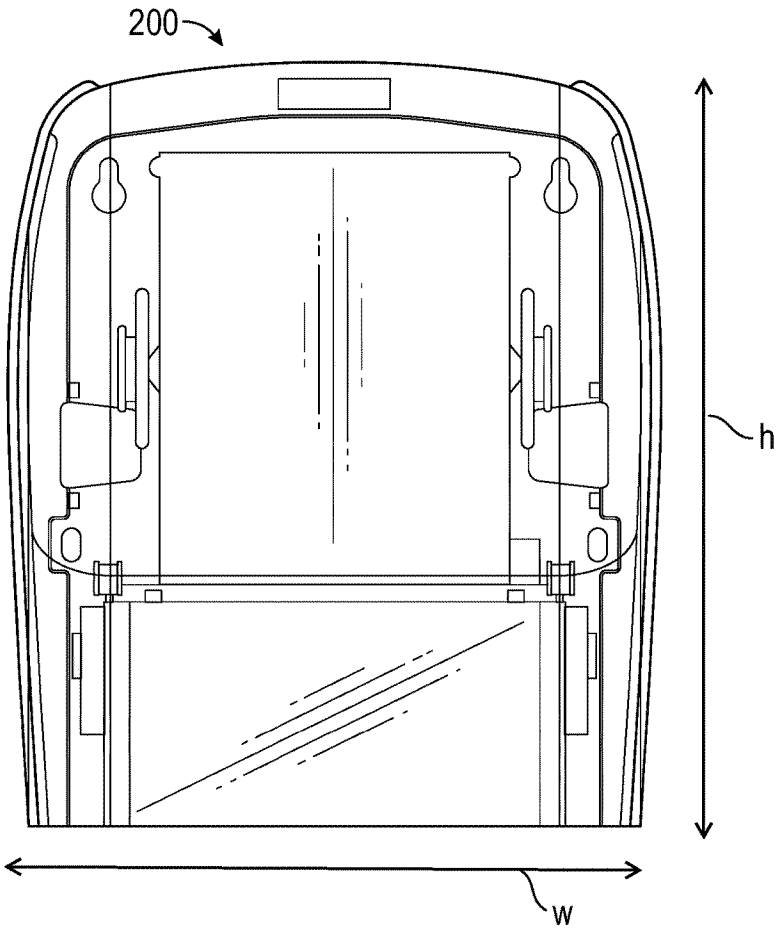

FIGS. 14A and 14B illustrate some exemplary dimensions of the roll feed mechanism 200. As shown in a front view in FIG. 14A, the roll feed mechanism can, for example, have a width "w" of 7.72 in. (196 mm) and a height "h" of 48.15 in. (1223 mm). As shown in a side view in FIG. 14B, the mechanism can, for example, have a depth "d" of 6.1 in (154 mm). However, other dimensions also can be used without departing from the present disclosure.

Figure 15B:
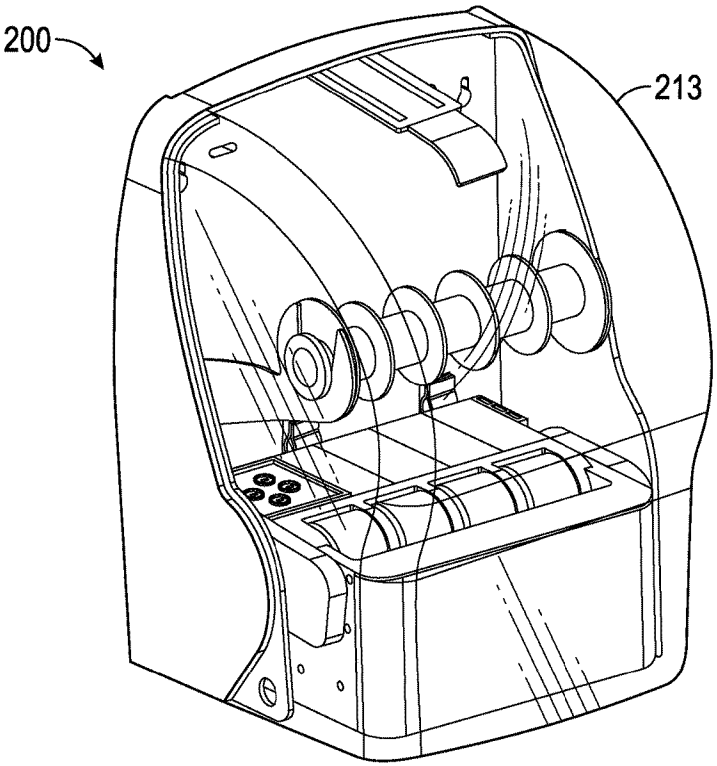
FIGS. 15A and 15B show a complete, assembled drive mechanism without a roll of paper installed thereon according to one embodiment.
Figure 15A:
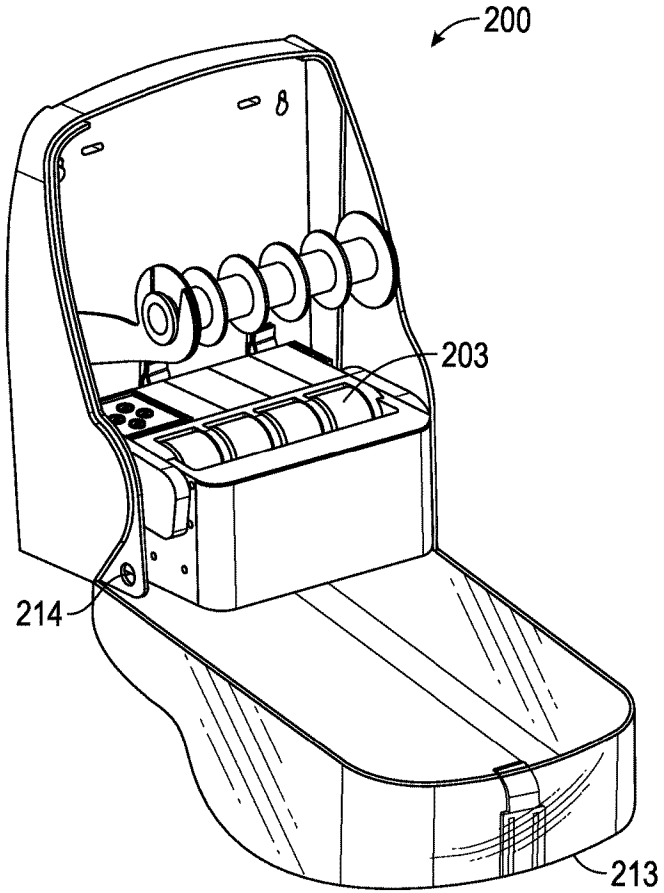

FIGS. 15A and 15B show the assembled roll feed mechanism 200 according to principles of the present disclosure without a roll of paper installed thereon. As shown in FIG. 15A, the cover 213 can be connected to the feed roll mechanism 200 by a hinge 214 and may be moved or pivoted downwardly, for example, to provide access to the interior of the roll feed mechanism, such as for installation of a full or partial roll of paper, or removal of an empty roll of paper. As shown in FIG. 15B, the cover 213 can be reclosed when and as desired. However, the cover 213 may be otherwise arranged or connected to the feed roller mechanism without departing from the present disclosure.

Figure 16A:
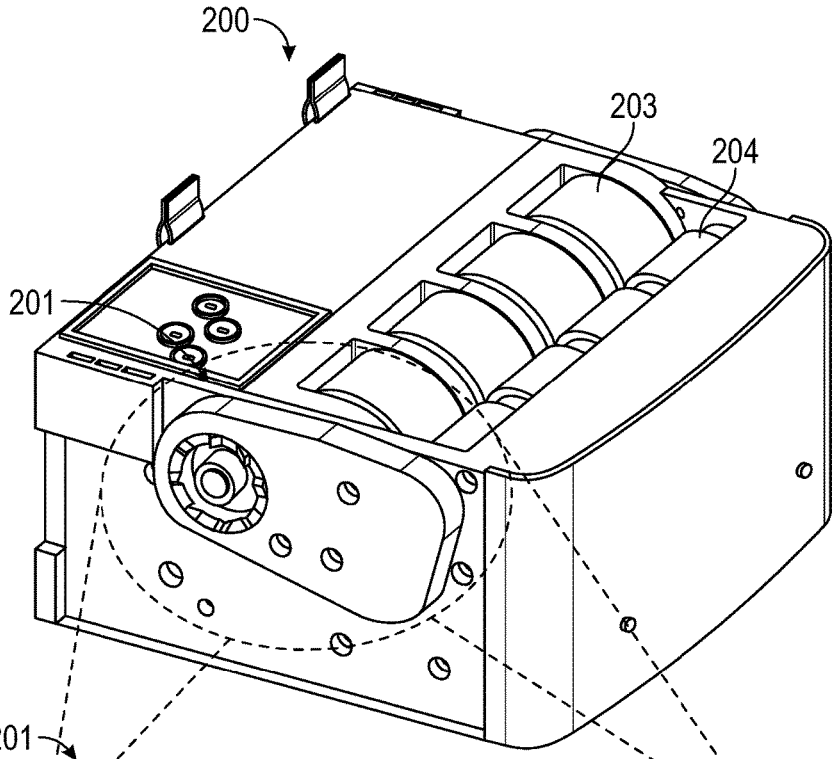
FIG. 16A shows the lower portion of the drive mechanism according to one embodiment.
Figure 16B:
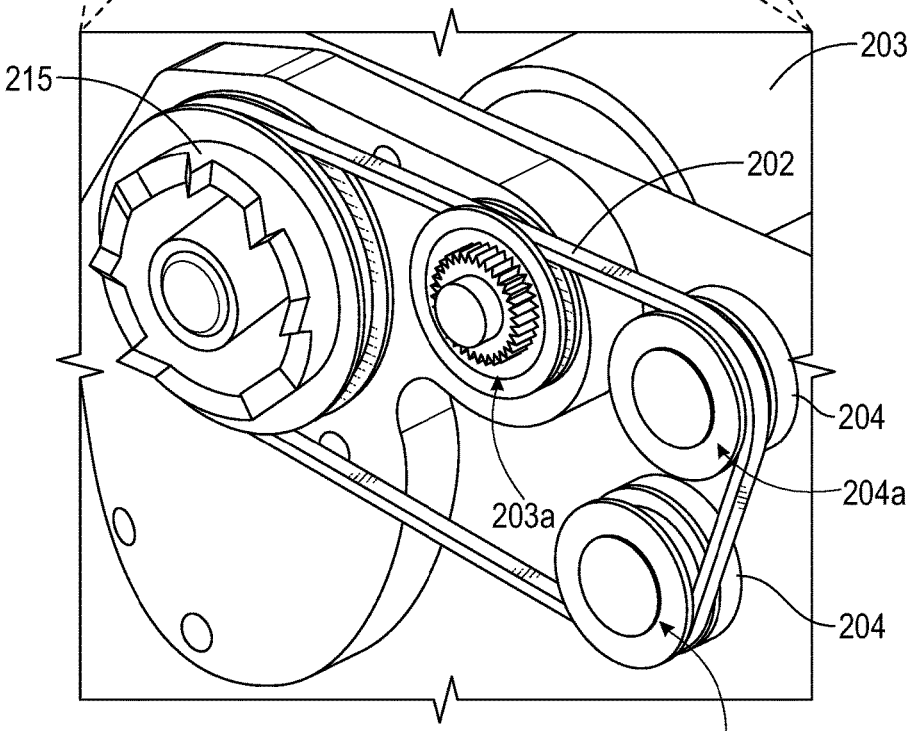
FIG. 16B shows a belt drive arrangement for the drive mechanism shown in FIG. 16A.

FIG. 16A shows the lower portion or base 210 of the roll feed mechanism 200 according to principles of the present disclosure. FIG. 16B shows an exploded view of an additional exemplary embodiment of the belt drive mechanism 201 showing the drive belt 202 engaging a belt gear 215 and extended around a sheave or end 203*a* of the paper roller 203 and sheaves or ends 204*a* of the pressing rollers 204 in an exploded view.

Figure 16C:
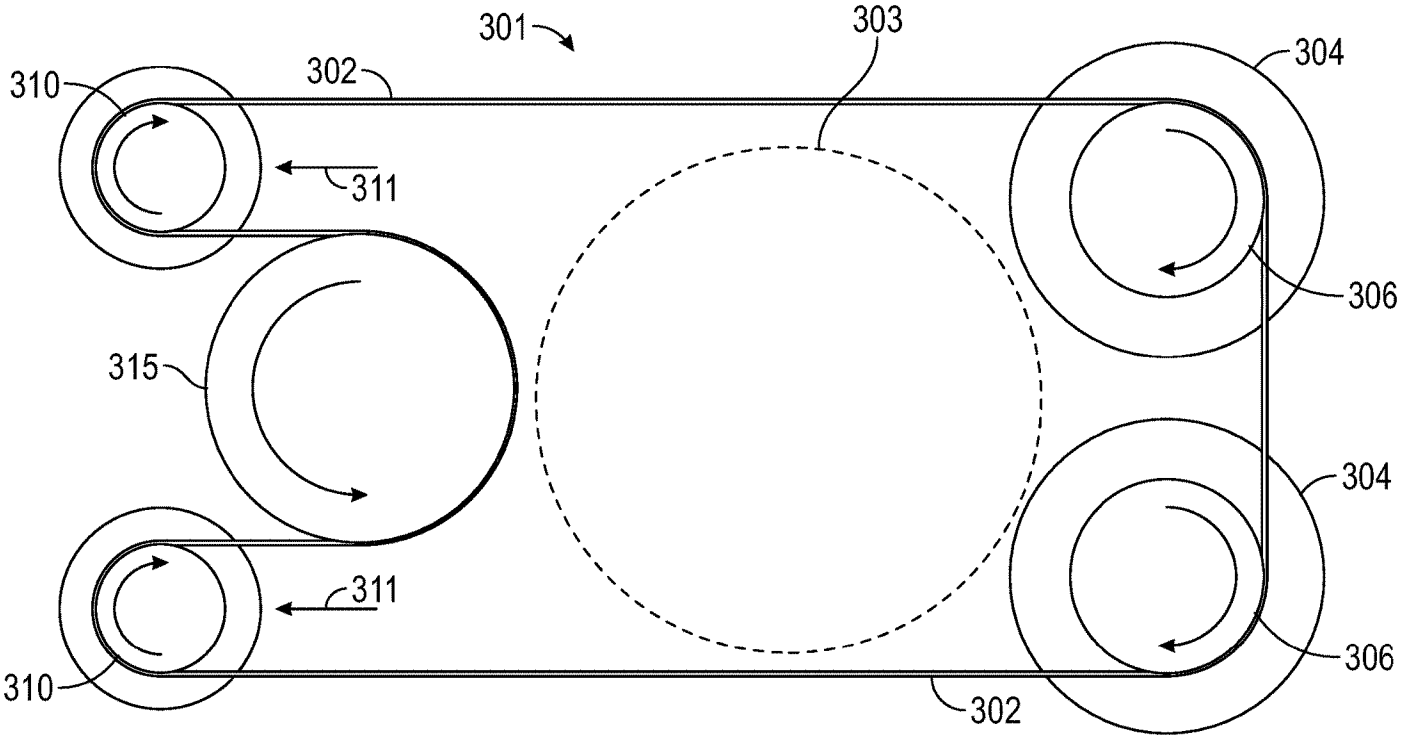
FIG. 16C shows a belt drive arrangement according to one embodiment of the present disclosure.

FIG. 16C shows a further alternative belt drive mechanism 301 according to an additional embodiment of the present disclosure. The belt drive mechanism 301 may include a sheave, pulley, or belt gear 315 operatively connected to the motor, e.g., by a transmission gear arrangement as shown in FIG. 10A or a drive belt as shown in FIG. 10B, though the belt gear 315 can be mounted directly the motor, e.g., on the driveshaft, without departing from this disclosure. The belt drive mechanism 301 further includes a drive belt 302 that engages the belt gear 315 and also extends about and operatively drives belt pulleys or sheaves 306 that can be connected to an end portion of one or more pressing rollers 304 to transfer torque from the motor therebetween. In addition, the drive belt mechanism 301 further can include pulleys, sheaves, gears, etc. 310 arranged/positioned adjacent the belt gear 315 and engaging the drive belt 302. The pulleys 310 may be biased or urged in a predetermined direction (e.g., away from the pressing rollers) by a biasing member indicated by arrows 311), such as one or more springs, to provide a substantially constant biasing force against, or to otherwise substantially maintain tension along, the drive belt 302. The magnitude of this biasing force or degree to which the drive belt 302 is tensioned may be selected such that the pressing rollers 304 are urged toward and substantially maintained against and in contact with the drive roller 303, and/or so that the drive belt 302 is sufficiently tensioned to prevent slippage between the drive belt 302 and the belt gear 315 or belt pulleys 306 of the pressing rollers 304.

Figure 17A:
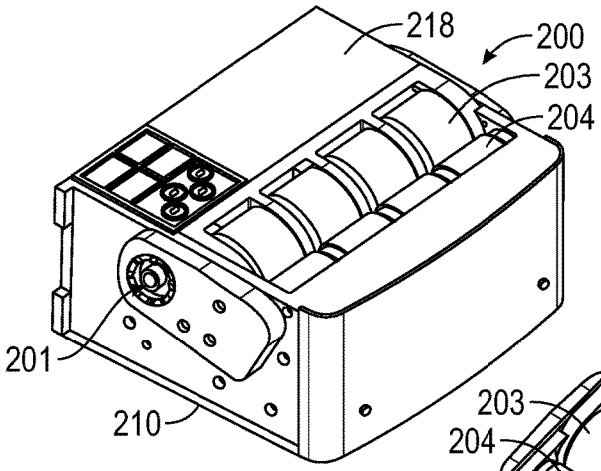
FIGS. 17A and 17C show the lower section of a base portion of a mechanism similar to the one detailed in FIG. 7.
Figure 17C:
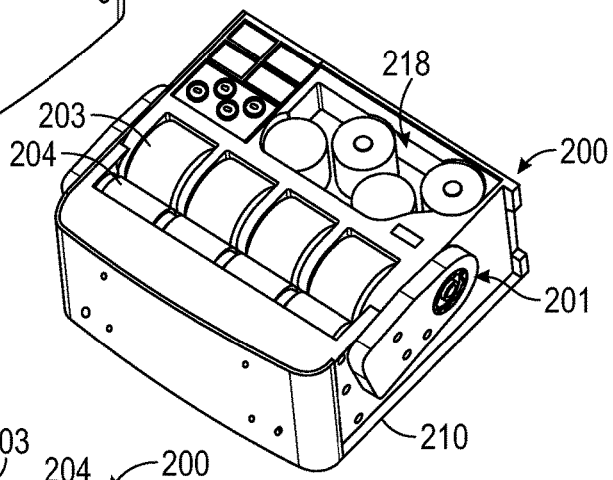
Figure 17B:
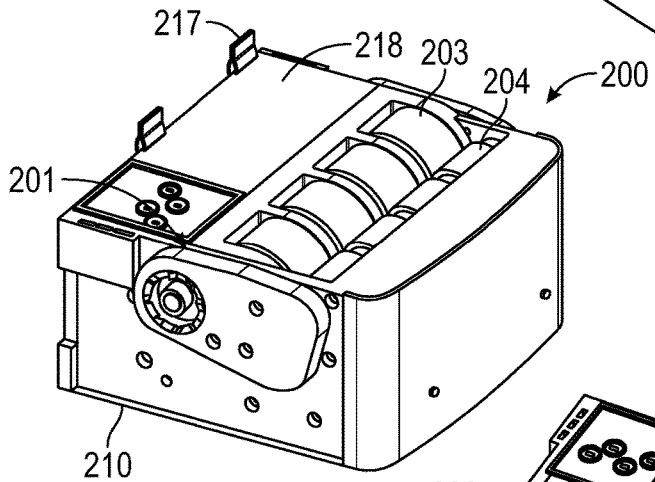
FIGS. 17B and 17D show a base portion of the drive mechanism according to one embodiment.
Figure 17D:
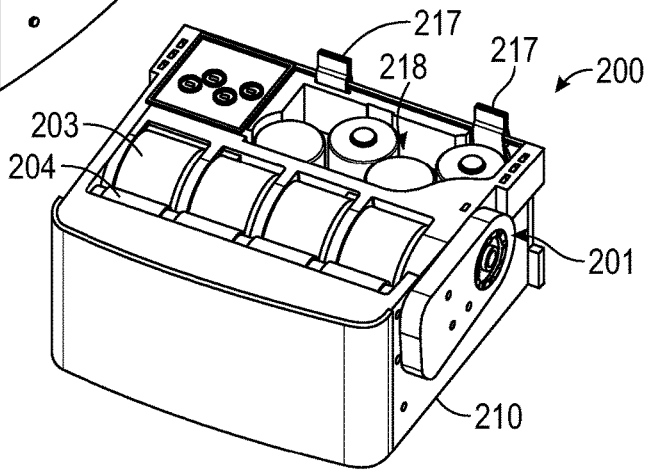

FIGS. 17A and 17C show the lower section or base portion 210 of a roll feed mechanism similar to the one detailed in FIG. 7. The circled portion of FIG. 17B shows removal assist tabs 217 that have been moved from a rear portion of a cover over the battery compartment 218 as seen in FIG. 17A and comprise a part of the base portion 210 as seen in FIG. 17B. FIGS. 17C and 17D also show the cover to the battery compartment being removed, with the removal assist tabs on the base in FIG. 17D and not in FIG. 17C.

Figure 18C:
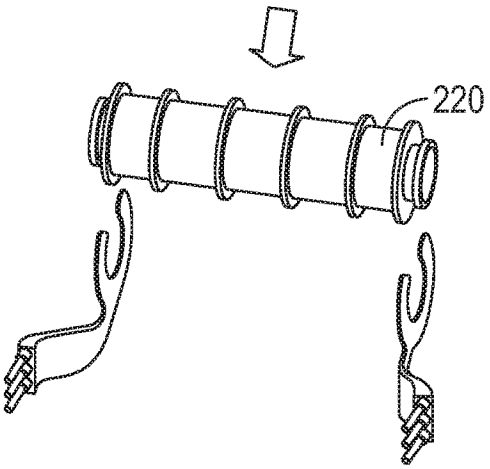
FIGS. 18A, 18B and 18C show exploded and assembled views of three different embodiments of rollers capable of being used with the drive mechanism according to one embodiment.
Figure 18C:
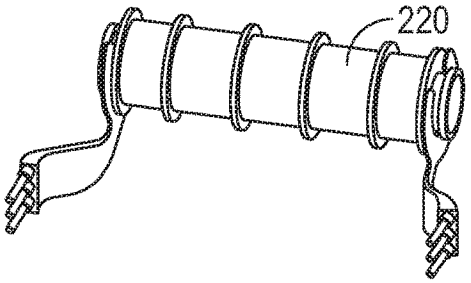
Figure 18B:
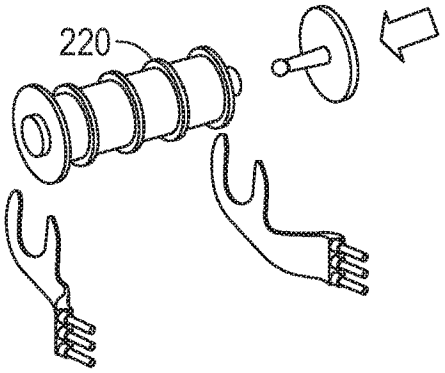
Figure 18B:
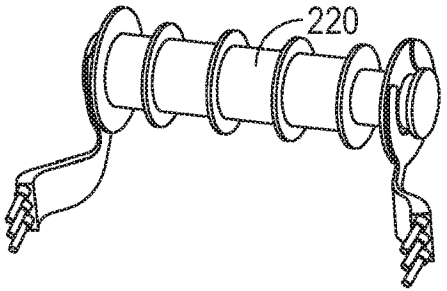
Figure 18A:
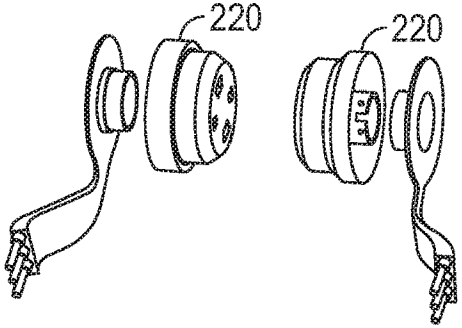
Figure 18A:
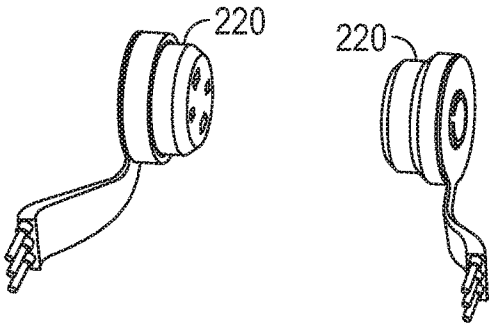

FIGS. 18A, 18B, and 18C show exploded and assembled views of three different embodiments of paper roll holders/rollers 220 capable of being used with embodiments of the present disclosure. The upper, exploded views, are sized to receive a roll of paper material and then can be assembled to retain the paper material in place for dispensing from the mechanism according to the operation of the mechanism.

Figure 19C:
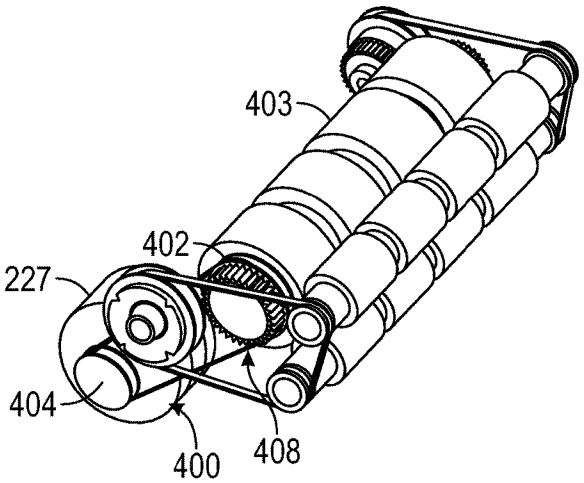
FIGS. 19C and 19D show the stepper motor and synchronous belt transmission for use in the drive mechanism according to one embodiment.
Figure 19D:
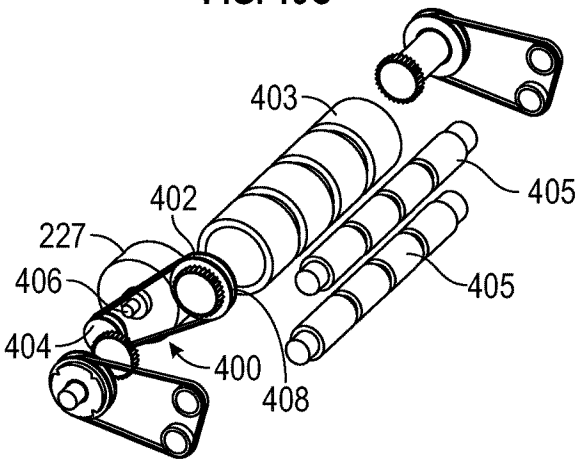
Figure 19A:
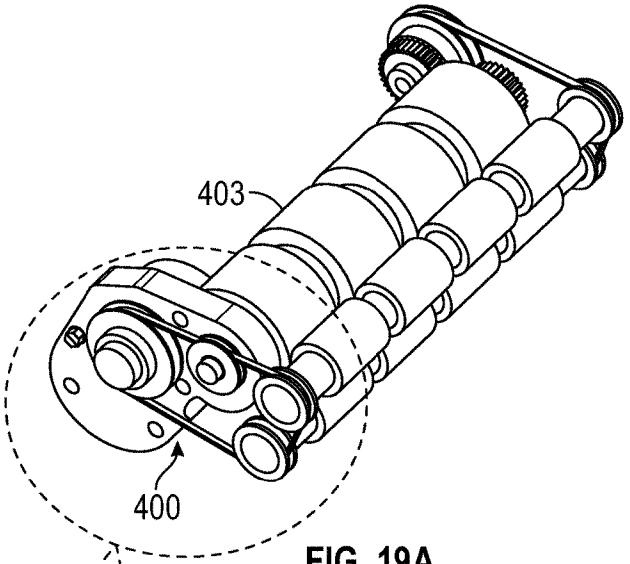
FIGS. 19A and 19B show a DC motor and gear transmission similar to the mechanism such as shown in FIG. 7.
Figure 19B:
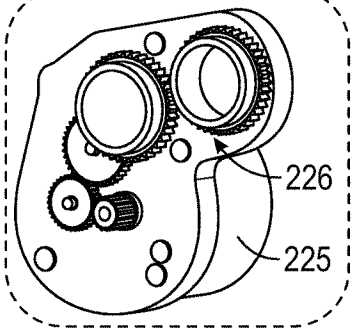

FIGS. 19A and 19B show a drive arrangement having DC motor 225 and gear transmission 226 similar to the roll feed mechanism detailed in FIG. 7, while FIGS. 19C and 19D show an alternative drive arrangement with a stepper 227 motor and synchronous belt drive mechanism/transmission arrangement 400 according to the principles of the present disclosure. In FIGS. 19C and 19D, an assembled version (FIG. 19C) is shown above an exploded version (FIG. 19D) of the stepper motor and synchronous belt transmission 400. With the embodiment shown in FIGS. 19C and 19D, the gear transmission 226 transferring torque/power from the motor to the feed roller is replaced with a synchronous belt transmission 400 including, for example, a belt 402 engaging a sheave, pulley or belt gear 404 attached or otherwise operatively coupled to the driveshaft 406 of the motor 227 and a pulley or sheave 408 attached to an end of the feed roller 403. Pressing rollers 405 also are shown in FIG. 19D. The belt transmission 400 of FIGS. 19C and 19D may operate with reduced friction due to the elimination of the gears and also may result in a substantially reduced noise signature, as well as require substantially less power for operation, in comparison with the gear transmission 226 of FIGS. 19A and 19B.

The embodiments shown in FIGS. 10A through 19D may provide reduction of noise and friction by utilizing belt drive technology with fewer plastic gears, by reducing noise and eliminating motor gearing required for brushed motors, and by improving overall dispenser efficiencies. Further embodiments of this disclosure may reduce the impact of paper dust build-up on exposed gears and bushings, with belts replacing plastic gears and concealed bushings. Even further, in order to maintain consistent belt tension, a spring loaded tension pulley device is provided herein.

The corresponding structures, materials, acts, and equivalents of all means plus function elements in any claims below are intended to include any structure, material, or acts for performing the function in combination with other claim elements as specifically claimed. Those skilled in the art will appreciate that many modifications to the exemplary embodiments are possible without departing from the scope of the present invention.

In addition, it is possible to use some of the features of the embodiments disclosed without the corresponding use of the other features. Accordingly, the foregoing description of the exemplary embodiments is provided for the purpose of illustrating the principles of the invention, and not in limitation thereof, since the scope of the present invention is defined solely by the appended claims.

What is claimed is:

1. A dispenser for flexible rolled sheet material, comprising:

a housing having a support mechanism for holding at least one roll of sheet material, said housing comprising a base for mounting to a surface, a cover movably mounted to the base, and a discharge chute formed within the housing for discharging the sheet material from the dispenser;

a feed roller and at least one pressing roller located and configured to engage and pull the sheet material therebetween for feeding;

a control circuit to control dispensing of the sheet material from the housing;

a dispensing mechanism to drive the sheet material from the housing upon receiving a signal from the control circuit, the dispensing mechanism including a motor and a belt drive mechanism, the motor operatively connected to the feed roller for driving the feed roller;

a proximity sensor having an adjustable detection range, wherein the dispensing mechanism is operative in a first mode to be responsive to a signal from the proximity sensor to dispense a sheet of the sheet material; and a tear bar mounted within the housing for severance of the sheet by a user;

wherein the belt drive mechanism comprises:

a drive belt operatively connected to the motor and to the at least one pressing roller to transfer power from the motor to the at least one pressing roller to drive rotation of the at least one pressing roller, wherein the drive belt is biased by a biasing member in a prescribed direction to provide a substantially constant biasing force against the drive belt to substantially maintain tension along the drive belt, and wherein the biasing force along with the tension along the drive belt urges the at least one pressing roller toward the feed roller such that the at least one pressing roller is substantially maintained against the feed roller, a belt gear operatively connected to the motor, at least one belt gear respectively operatively connected to the at least one pressing roller, and at least one additional belt gear biased by the biasing member in the prescribed direction, wherein the drive belt engages the at least one belt gear operatively connected to the motor and engages the at least one belt gear respectively operatively connected to the at least one pressing roller to transfer power from the motor to the at least one pressing roller to drive rotation of the at least one pressing roller, and wherein the at least one additional belt gear biased by the biasing member engages the drive belt to provide the biasing force to substantially maintain the tension along the drive belt.

2. The dispenser of claim 1, further comprising:

a pivotally mounted pawl member located proximate the tear bar such that movement of sheet material into the tear bar for severance pivots the pawl member from a first position to a second position.

3. The dispenser of claim 2, further comprising a signal means cooperative with the pawl member, the signal means including an infrared emitter and detector positioned opposite one another such that pivoting of the pawl member to the second position blocks reception of emitted light by the detector thereby sending a signal to the control circuit.

4. The dispenser of claim 1, further comprising a multi-position switch in operable communication with the control circuit to select one of a plurality of sheet lengths to be dispensed by the dispensing mechanism.

5. The dispenser of claim 1, wherein the proximity sensor is mounted in a bottom section of the dispenser housing forward of the discharge chute facing downward and slightly rearward toward an outermost edge of the discharge chute.

6. The dispenser of claim 1, further comprising a paper detection sensor including at least one infrared emitter and at least one infrared receiver aligned to detect a sheet hanging below an outermost front edge of the discharge chute.

7. The dispenser of claim 6, wherein the at least one infrared receiver is positioned to oppose and receive signals from the at least one infrared emitter.

8. The dispenser of claim 1, wherein the support mechanism for the at least one roll of sheet material is pivotally mounted within the housing.

9. The dispenser of claim 1, wherein the at least one pressing roller comprises a first pressing roller and a second pressing roller, and wherein the drive belt operatively engages the first pressing roller and the second pressing roller to drive rotation of the first pressing roller and the second pressing roller.

10. The dispenser of claim 9, wherein the drive belt is biased and tensioned by the biasing member such that the first pressing roller and the second pressing roller are urged toward and substantially maintained against the feed roller.

* * * * *